US008433223B2

(12) United States Patent
Ishii

(10) Patent No.: US 8,433,223 B2
(45) Date of Patent: Apr. 30, 2013

(54) IMAGE FORMING APPARATUS FORMING TRANSPARENT TONER COAT LAYER ON RECORDING MEDIUM

(75) Inventor: Hiroshi Ishii, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 422 days.

(21) Appl. No.: 12/785,557

(22) Filed: May 24, 2010

(65) Prior Publication Data

US 2010/0303489 A1 Dec. 2, 2010

(30) Foreign Application Priority Data

Jun. 1, 2009 (JP) ..... 2009-132548

(51) Int. Cl.
*G03G 15/01* (2006.01)
*G03G 15/20* (2006.01)

(52) U.S. Cl.
USPC ..... 399/223; 399/341

(58) Field of Classification Search ..... 399/223, 399/298, 299, 302, 303, 341
See application file for complete search history.

(56) References Cited

U.S. PATENT DOCUMENTS 7,769,328 B2 * 8/2010 Murayama et al. ..... 399/299
7,991,328 B2 * 8/2011 Masui ..... 399/223
8,086,161 B2 * 12/2011 Omata ..... 399/341
2007/0053726 A1 3/2007 Noguchi et al.
2007/0207402 A1 9/2007 Takagi et al.
2007/0218375 A1 9/2007 Ito

FOREIGN PATENT DOCUMENTS

JP 07-248662 9/1995
JP 08-106172 A 4/1996
JP 2002-341623 A 11/2002
JP 2003-330228 A 11/2003
JP 1928731 A 3/2007
JP 2007-233101 A 9/2007
JP 2007-256359 A 10/2007
JP 2008-003240 A 1/2008
JP 2008-145595 6/2008

* cited by examiner

*Primary Examiner* — William J Royer
(74) *Attorney, Agent, or Firm* — Renner, Otto, Boisselle & Sklar, LLP

(57) ABSTRACT

An image forming apparatus includes a photoreceptor drum, a charging part, an exposure unit, a developing part which feeds a photoreactive toner, a color formation exposure part, a transfer part, a recording medium feeding part, a fixing part, and a control unit part which controls operations of the above elements. The control unit part controls such that a photoreactive toner processed so as not to develop a color is transferred to a recording medium having transferred or fixed thereto a toner image processed so as to develop a color, and a photoreactive toner processed so as not to develop a color is fixed to an image formed on the recording medium, thereby forming a transparent toner coat layer which is a colorless and transparent toner layer.

8 Claims, 6 Drawing Sheets

IMAGE FORMING APPARATUS FORMING TRANSPARENT TONER COAT LAYER ON RECORDING MEDIUM

CROSS-REFERENCE TO RELATED APPLICATION

This application claims priority to Japanese Patent Application No. 2009-132548, which was filed on Jun. 1, 2009, the contents of which are incorporated herein by reference in its entirety.

BACKGROUND OF THE INVENTION

1. Field of the Invention

The present invention relates to an image forming apparatus which forms a transparent toner coat layer on a recording medium.

2. Description of the Related Art

Electrophotographic image forming apparatus can form a high quality image with good reproducibility and inexpensively, and is therefore widely used as a copying machine, a printer, a facsimile apparatus and the like. The electrophotographic image forming apparatus comprises, for example, a photoreceptor, a charging device, an exposure device, a developing device, a transfer device and a fixing device, and forms an image by fixing a toner to a recording medium such as a printing paper.

Photoreactive toner as described in Japanese Unexamined Patent Publications JP-A 2007-233101, JP-A 2008-3240 and JP-A 8-106172 (1996) is known as one of toners used in the electrophotographic image forming apparatus. The photoreactive toner is a toner that can develop multiple different colors by being irradiated with light having a given wavelength. Where such a photoreactive toner is used in the electrophotographic image forming apparatus, a full color image can be formed by one kind of a toner.

To form a high quality image in an electrophotographic image forming apparatus, a technique of improving smoothness of a whole printing paper is known. The image forming apparatus described in Japanese Unexamined Patent Publication JP-A 2002-341623 forms a color toner image on an image area as well as fixing a colorless and transparent toner to a non-image area in order to improve smoothness of the whole printing paper.

In recent years, improvement in storage stability of an image formed on a printing paper and the like is desired in response to high definition of an image formed by an electrophotographic image forming apparatus. However, it is not easy to improve storage stability of an image by improving properties of a toner.

SUMMARY OF THE INVENTION

The invention has been made to solve those problems, and has an object to provide an image forming apparatus that can form an image having excellent rubbing resistance, waterproof property and storage stability.

The invention provides an image forming apparatus comprising:

a photoreceptor having a photosensitive layer;

a charging device which charges the photoreceptor;

an exposure device which exposes the charged photoreceptor to light, thereby forming an electrostatic latent image on a surface of the photoreceptor;

a first developing device which feeds a photoreactive toner which produces a given color by being irradiated with given light and further being heated, to the electrostatic latent image, thereby forming a toner image on a surface of the photoreceptor;

a color formation exposure device which exposes the photoreactive toner forming the toner image with given light;

a transfer device which transfers the toner image to a recording medium;

a fixing device which fixes the toner image transferred to the recording medium, onto the recording medium by heating the recording medium, thereby forming an image on the recording medium; and a control device which controls operations of the photoreceptor, the charging device, the exposure device, the first developing device, the color formation exposure device, the transfer device and the fixing device, the control device carrying out control such that a photoreactive toner processed so as not to develop a color is transferred to a recording medium having transferred or fixed thereto a toner image processed so as to develop a color, and the photoreactive toner processed so as not to develop a color is fixed to an image formed on the recording medium, thereby forming a transparent toner coat layer which is a colorless and transparent toner layer.

According to the invention, formation of an image and formation of a transparent toner coat layer can be conducted by one developing device. When a transparent toner coat layer is formed on an image, rubbing resistance, waterproof property and storage stability of the image is improved. Therefore, an image having excellent rubbing resistance, waterproof property and storage stability can be formed by a downsized image forming apparatus.

Further, in the invention, it is preferable that the control device carries out control such that a first fixing temperature which is a temperature of the fixing device when fixing the toner image to a recording medium is higher than a second fixing temperature which is a temperature of the fixing device when forming the transparent toner coat layer.

According to the invention, generation of high temperature offset due to heat storage of a recording medium can be prevented.

Further, in the invention, it is preferable that the transfer device includes a recording medium reversing part which reverses a recording medium by a switchback mechanism such that a side of the recording medium opposite a side facing the photoreceptor in just before transferring faces the photoreceptor in the next transfer.

According to the invention, double face printing can be conducted by a simple constitution.

Further, in the invention, it is preferable that the image forming apparatus further comprises a second developing device which feeds a black toner being a toner for forming a black image to the electrostatic latent image, thereby forming the toner image, the control device further controls operations of the second developing device, and the control device carries out control so as to form the black image by the black toner in a case where an image to be formed on the recording medium contains a black image.

According to the invention, a black image can be definitely formed as compared with the case of forming a black image by a photoreactive toner having produced a black color.

Further, in the invention, it is preferable that the photoreceptor includes a first photoreceptor on which the toner image is formed by the first developing device, and a second photoreceptor on which the toner image is formed by the second developing device, the transfer device is constituted such that the toner image comprising the photoreactive toner is transferred to the recording medium, and the toner image comprising the black toner is then transferred to the recording medium, and the control device carries out control such that the toner image transferred to the recording medium is fixed to the recording medium, the photoreactive toner processed so as not to develop a color is transferred to the recording medium, and the transparent toner coat layer is then formed on the recording medium.

According to the invention, a toner image comprising the black toner transferred to a recording medium does not contact the first photoreceptor, and this can prevent the black toner from incorporating into the first developing device.

Further, in the invention, it is preferable that the photoreceptor includes a first photoreceptor on which the toner image is formed by the first developing device, and a second photoreceptor on which the toner image is formed by the second developing device, the transfer device is constituted such that a toner image comprising the black toner is transferred to the recording medium, and a toner image comprising the photoreactive toner is then transferred to the recording medium, and the control device carries out control such that in a case where an image to be formed on the recording medium consists of a black image, the toner image consisting of a black toner is transferred to the recording medium, photoreactive toner processed so as not to develop a color is transferred to the recording medium before fixing the toner image to the recording medium, and fixation of the toner image to the recording medium and formation of the transparent toner coat layer are then conducted at once.

According to the invention, a monochrome image coated with a transparent toner coat layer can be formed on a recording medium in a relatively short period of time.

Further, in the invention, it is preferable that the image forming apparatus further comprises a second photoreceptor separating/contacting part which separates/contacts the second photoreceptor and the transfer device by moving the second photoreceptor, the control device further controls operations of the second photoreceptor separating/contacting part, and the control device carries out control such that the second photoreceptor separates from the transfer device, except when the toner image comprising a black toner is transferred to the recording medium.

According to the invention, the recording medium does not contact a second photoreceptor drum during the period of from formation of an image on a recording medium to formation of a transparent toner coat layer on the image. Therefore, this can prevent contamination of the recording medium due to the contact of a black toner on a surface of the second photoreceptor with the recording medium.

The invention further provides an image forming apparatus comprising:

a photoreceptor having a photosensitive layer;

a charging device which charges the photoreceptor;

an exposure device which exposes the charged photoreceptor to light, thereby forming an electrostatic latent image on a surface of the photoreceptor;

a chromatic toner developing device which feeds a chromatic toner being a toner for forming an image to the electrostatic latent image, thereby forming a chromatic toner image on a surface of the photoreceptor;

a transparent toner developing device which feeds a transparent toner being a toner for forming a transparent toner coat layer which is a colorless and transparent toner layer to the electrostatic latent image, thereby forming a transparent toner image on a surface of the photoreceptor;

a chromatic toner image transfer device which transfers the chromatic toner image to a recording medium;

a transparent toner image transfer device which transfers the transparent toner image to the recoding medium;

a fixing device which fixes the chromatic toner image to the recording medium by heating the recording medium having transferred thereto the chromatic toner image, thereby forming an image on the recording medium; and a control device which controls operations of the photoreceptor, the charging device, the exposure device, the chromatic toner developing device, the transparent toner developing device, the chromatic toner image transfer device, the transparent toner image transfer device and the fixing device, the control device carrying out control such that the transparent toner image is transferred to the recording medium having the chromatic toner image transferred or fixed thereto and the transparent toner image is fixed to an image formed on the recoding medium, thereby forming a transparent toner coat layer which is a colorless and transparent toner layer.

According to the invention, an image coated with a transparent toner coat layer can be formed on a recording medium. Therefore, an image having excellent rubbing resistance, waterproof property and storage stability can be formed.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
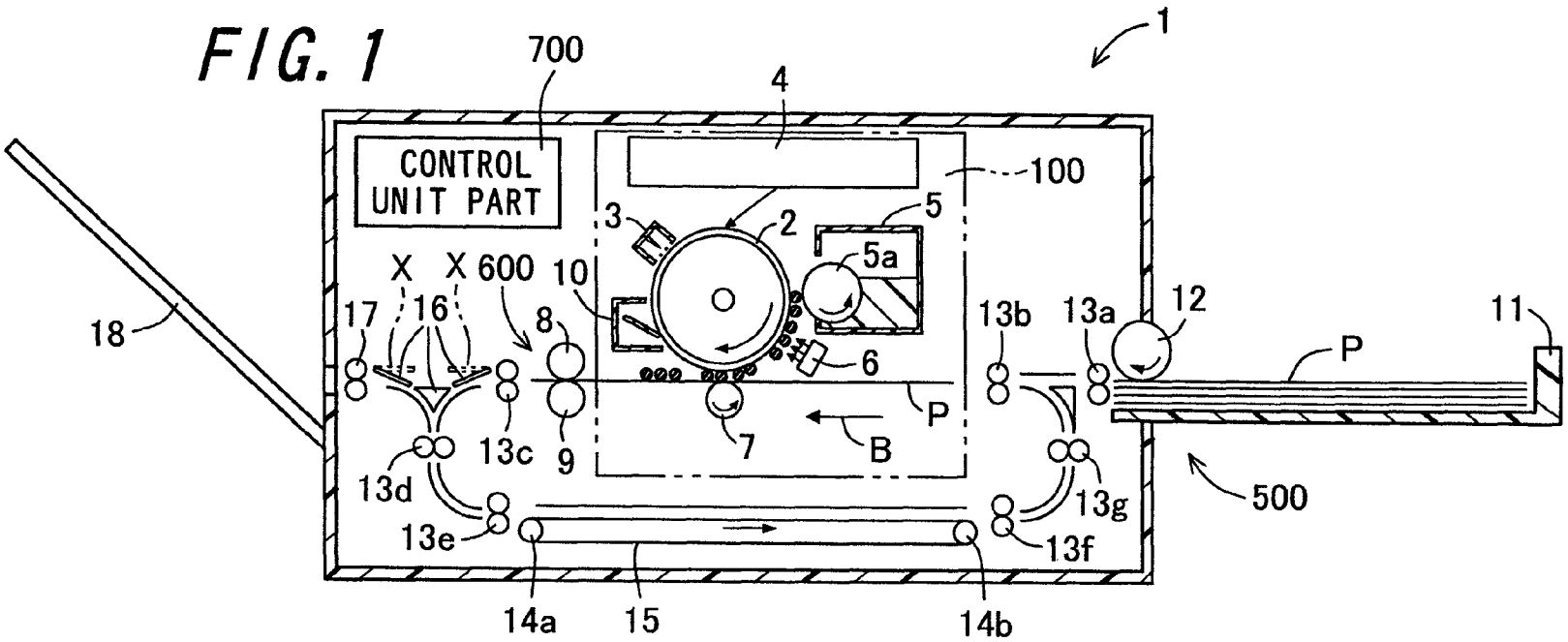
FIG. 1 is a schematic view schematically showing a cross-section of an image forming apparatus.

Now referring to the drawings, preferred embodiments of the invention are described below.

An image forming apparatus equipped with a developing device which feeds a photoreactive toner and forming an image and a transparent toner coat layer by the developing device is hereinafter referred to as an image forming apparatus according to a first aspect of the invention. On the other hand, an image forming apparatus equipped with a developing device which feeds a toner for forming an image and a developing device which feeds a transparent toner for forming a transparent toner coat layer is hereinafter referred to as an image forming apparatus according to a second aspect of the invention.

The image forming apparatus according to the first aspect of the invention comprises a photoreceptor, a charging device, an exposure device, a first developing device, a color formation exposure device, a transfer device, a fixing device and a control device. An image forming apparatus 1 which is a first embodiment of the image forming apparatus according to the first aspect of the invention is described below.

FIG. 1 is a schematic view schematically showing a cross-section of the image forming apparatus 1. The image forming apparatus 1 is a multifunctional peripheral having a copying function, a printer function and a facsimile function in combination. The image forming apparatus 1 forms a full color or monochrome image on a recording medium P according to image information inputted as a digital signal from a scanner part (not shown) or the like. The image forming apparatus 1 comprises a toner image forming part 100, a recording medium feeding part 500, a fixing part 600 and a control unit part 700.

The toner image forming part 100 comprises a photoreceptor drum 2, a charging part 3, an exposure unit 4, a developing part 5, a color formation exposure part 6, a transfer part 7 and a drum cleaner 10. The recording medium feeding part 500 comprises a recording medium storage part 11, a pickup roller 12, conveying rollers 13*a*, 13*b*, 13*c*, 13*d*, 13*e*, 13*f* and 13*g* (when the conveying rollers 13*a* to 13*g* each are not distinguished, those rollers are represented by conveying rollers 13), supporting rollers 14*a* and 14*b*, a conveying belt 15, a path switching part 16, discharge rollers 17 and a paper discharge part 18. The fixing part 600 comprises a fixing roller 8 and a pressure roller 9.

In the present embodiment, the photoreceptor drum 2 is the above-described photoreceptor. The charging part 3 is the above-described charging device. The exposure unit 4 is the above-described exposure device. The developing part 5 is the above-described first developing device. The color formation exposure part 6 is the above-described color formation exposure device. The transfer part 7 and the recording medium feeding part 500 is the above-described transfer device. The fixing part 600 is the above-described fixing device. The control unit part 700 is the above-described control device.

The photoreceptor drum 2 is a roller-like member which is supported so as to be rotatable around an axis thereof by a driving part (not shown). The photoreceptor drum 2 has a photosensitive layer, and is an image bearing member which bears an electrostatic latent image, and eventually a toner image, on a surface of the photosensitive layer.

The photoreceptor drum 2 can use a material comprising a conductive substrate comprising aluminum or the like, and a photosensitive layer formed on a surface of the conductive substrate. The conductive substrate can use, for example, a cylindrical, columnar or sheet-like conductive substrate. Among them, a cylindrical conductive substrate can preferably be used. The photosensitive layer includes an organic photosensitive layer and an inorganic photosensitive layer.

The organic photosensitive layer includes a laminate of a charge generating layer which is a resin layer containing a charge generating substance, and a charge transporting layer which is a resin layer containing a charge transporting substance, and a resin layer containing a charge generating substance and a charge transporting substance in one resin layer. The inorganic photosensitive layer includes a resin layer containing at least one selected from zinc oxide, selenium, amorphous silicon and the like.

An undercoat layer may be interposed between the conductive substrate and the photosensitive layer. A surface layer (protective layer) for protecting the photosensitive layer may be provided on a surface of the photosensitive layer.

The charging part 3 is a corona discharge device which charges a surface of the photoreceptor drum 2 in given polarity and potential by corona discharge. The charging part 3 faces the photoreceptor drum 2 and is arranged by providing a given interval to the surface of the photoreceptor drum 2 along a longitudinal direction of the photoreceptor drum 2. The charging part 3 may use a contact charging type charger such as a charging roller, a charging brush or a magnetic brush, other than a corona discharge device.

The exposure unit 4 is a laser scanning unit which forms an electrostatic latent image responding to an image information on a surface of the photoreceptor drum 2 by exposing the surface of the photoreceptor drum 2 in a charged state with laser light according to an image information of each color. The exposure unit 4 may use, for example, a unit comprising an LED (Light Emitting Diode) array, a liquid crystal shutter and a light source in appropriate combination, other than a laser scanning unit.

The developing part 5 is a container-like member having an inner space, and is provided to face the photoreceptor drum 2. The developing part 5 stores a developer in the inner space. The developer may be a one-component developer consisting of a toner, and may be a two-component developer comprising a toner and a known carrier.

The toner used in the present embodiment is a photoreactive toner which develops a given color by being irradiated with given light and further being heated. The photoreactive toner comprises a dye precursor, a developer and a photocurable composition. The dye precursor reacts with the developer in fixing by the fixing part 600 described hereinafter by curing the photocurable composition with light having a given wavelength emitted by the color formation exposure part 6 described hereinafter. The photoreactive toner is a toner which develops a given color by this reaction. The photoreactive toner is colorless and transparent in the case of not developing a color. In the first aspect of the invention and the second aspect of the invention, the term "the toner is colorless and transparent" means that transmittance (outgoing light/incident light) which is a ratio of intensity of visible light outgone from the toner to intensity of visible light entering the toner is 80% or more. The details of the photoreactive toner are described hereinafter.

The developing part 5 has an opening formed on a side facing the photoreceptor drum 2. The developing part 5 is equipped with a developing roller 5*a*. The developing roller 5*a* is provided such that a part thereof projects outward from the developing part 5 from the opening formed on a side facing the photoreceptor drum 2, and is close to a surface of the photoreceptor drum 2.

The developing roller 5*a* is a roller-like member rotatably supported around an axis thereof. The developing roller 5*a* has stationary magnetic poles (not shown) therein, and a developer is borne on a surface of the developing roller 5*a* by the stationary magnetic poles. The developing roller 5*a* feeds the developer borne on the surface thereof to an electrostatic latent image on a surface of the photoreceptor drum 2 in an adjacent portion (developing nip region) between the developing roller 5*a* and the photoreceptor drum 2. This forms a toner image on the surface of the photoreceptor drum 2.

The developing roller 5*a* is connected to a power source (not shown). The developing roller 5*a* smoothly feeds a developer to an electrostatic latent image on the surface of the photoreceptor drum 2 by applying direct current voltage (developing voltage) from the power source.

The color formation exposure part 6 is a laser scanning unit which emits given light to a photoreactive toner forming a toner image formed on the surface of the photoreceptor drum 2 or a toner image transferred to a recording medium P by the transfer part 7 described hereinafter. The color formation exposure part 6 cures a specific photocurable composition contained in the photoreactive toner by emitting light having a given wavelength to the photoreactive toner based on image information. In the present embodiment, the color formation exposure part 6 is constituted such that three kinds of lights, light $\lambda_1$ having a wavelength of 405 nm, light $\lambda_2$ having a wavelength of 532 nm and light $\lambda_3$ having a wavelength of 657 nm, can be emitted.

In the present embodiment, the color formation exposure part 6 is provided so as to face the photoreceptor drum 2 such that the toner image on the surface of the photoreceptor drum 2 can be irradiated with light. As another embodiment, the color formation exposure part 6 may be provided at a position where the toner image on a recording medium P can be irradiated with light before the toner image is fixed with the fixing part 600 described hereinafter.

Other than a laser scanning unit, units obtained by appropriately combining an LED array, a liquid crystal shutter and a power source may be used as the color formation exposure part 6.

The transfer part 7 is a roller-like member provided so as to be rotatable around an axis thereof with a driving part (not shown). The transfer part 7 is provided so as to face the photoreceptor drum 2. The transfer part 7 transfers a toner image on a surface of the photoreceptor drum 2 to a recording medium P in a region (transfer region) sandwiched between the photoreceptor drum 2 and the transfer part 7 by sandwiching the recording medium P sent from a recording medium feeding part 500 described hereinafter between the transfer part 7 and the photoreceptor drum 2. The recording medium P having the toner image transferred thereto is sent to the fixing part 600 by the transfer part 7.

The transfer part 7 uses, for example, a roller-like member comprising a metal shaft and a conductive layer covering a surface of the metal shaft. The metal shaft is formed by, for example, a metal such as stainless steel. The conductive layer is formed by, for example, a conductive elastomer. The conductive elastomer can use materials conventionally used in this field, and examples thereof include ethylene-propylene-diene rubber (EPDM), foamed EPDM and foamed urethane, each containing a conductive agent such as carbon black.

The transfer part 7 is connected to a high voltage power source (not shown). A high voltage having reverse polarity to a charged polarity of a toner image formed on the surface of the photoreceptor drum 2 is applied to the transfer part 7 from the high voltage power source. This smoothly transfers a toner image formed on the surface of the photoreceptor drum 2 to the recording medium P.

The drum cleaner 10 is a member which removes and collects residual toner on the surface of the photoreceptor drum 2 after the toner image on the surface of the photoreceptor drum 2 has been transferred to the recording medium P. The drum cleaner 10 comprises, for example, a cleaning blade which scrapes the residual toner by coming into pressure-contact with the surface of the photoreceptor drum 2, and a collection container which stores the residual toner scraped with the cleaning blade.

The recording medium storage part 11 is a tray-like member which stores a recording medium P. Examples of the recording medium P include plain papers, coat papers, color copy exclusive papers, OHP films, and postcards. Examples of a size of the recording medium P include A4, A3, B5, B4, and postcard size.

The pickup roller 12 is a roller-like member which sends a recording medium P to the conveying rollers 13*a* sheet by sheet. The pickup roller 12 sends the recording medium P such that a period at which a toner image on the surface of the photoreceptor drum 2 is conveyed to a transfer region is synchronized with a period at which the recording medium P is conveyed to the transfer region.

The conveying rollers 13*a* to 13*g* are a pair of roller-like members provided so as to come into pressure- contact with each other. The conveying rollers 13*a* send a recording medium P sent from the pickup roller 12 to the conveying rollers 13*b*. The conveying rollers 13*b* send the recording medium P sent from the conveying rollers 13*a* to a transfer region. The recording medium P is conveyed in a conveyance direction shown by an arrow B by the conveying rollers 13*b*. The conveying rollers 13*c* send the recording medium P sent from the fixing part 600 described hereinafter to a path switching part 16.

The path switching part 16 is a member which switches a conveyance path of the recording medium P. Specifically, when a part of the path switching part 16 is located at a position of a solid line shown in FIG. 1, the recording medium P sent from the conveying rollers 13*c* is sent to the conveying rollers 13*d*. When a part of the path switching part 16 is located at a position of dashed-two dotted line X shown in FIG. 1, the recording medium P sent from the conveying rollers 13*c* is sent to the discharge rollers 17.

The conveying rollers 13*d* send the recording medium P sent from the conveying rollers 13*c* to the conveying rollers 13*e*. The conveying rollers 13*e* send the recording medium P sent from the conveying rollers 13*d* to the conveying belt 15.

The conveying belt 15 is an endless belt-like member supported around the supporting rollers 14*a* and 14*b* with tension. The conveying belt 15 can use, for example, a semiconductive belt having a thickness of 200 μm comprising a polycarbonate resin having kneaded therewith carbon black. The conveying belt 15 sends the recording medium P sent from the conveying rollers 13*e* to the conveying rollers 13*f* by moving the recording medium P due to the rotation thereof while bearing the same thereon.

The supporting rollers 14*a* and 14*b* are roller-like members provided so as to be rotatable around an axis thereof by a driving part (not shown). The supporting rollers 14*a* and 14*b* use, for example, an aluminum cylindrical body (pipe-like roller).

The conveying rollers 13*f* send the recording medium P sent from the conveying belt 15 to the conveying rollers 13*g*. The conveying rollers 13*g* send the recording medium P sent from the conveying rollers 13*f* to the conveying rollers 13*b*. Thus, a loop-like conveyance path is formed by the conveying rollers 13*b* to 13*g*.

The discharge rollers 17 are a pair of roller-like members provided so as to come into pressure-contact with each other. The discharge rollers 17 are provided so as to rotatable around an axis thereof by a driving part (not shown). The discharge rollers 17 discharge the recording medium P sent from the conveying rollers 13*c* to the paper discharge part 18.

The discharge rollers 17 can be rotationally driven in a direction opposite a rotation direction for discharging the recording medium P to the paper discharge part 18. The discharge rollers 17 catch a tail end of the recording medium P by the order from the control unit part 700 described hereinafter, and are rotationally driven in the opposite direction, thereby sending the recording medium P to the path switching part 16. In this case, a part of the path switching part 16 is located at a position of a solid line shown in FIG. 1. Therefore, the recording medium P is sent to the conveying rollers 13*d*. Thus, the path switching part 16 and the discharge roller 17 constitute a switchback mechanism.

As described above, the conveying rollers 13*b* to 13*g* form a loop-like conveyance passage. Therefore, the recording medium feeding part 500 can reverse the recording medium P such that a side of the recording medium P opposite a side facing the photoreceptor drum 2 in just before transferring faces the photoreceptor drum 2 in the next transfer by the loop-like conveyance path and the switchback mechanism. That is, the recording medium feeding part 500 has a recording medium reversing part. This permits the image forming apparatus 1 to form an image on both sides of the recording medium P (double face printing).

The paper discharge part 18 is a tray-like member which stores a recording medium P having a toner image fixed by the fixing part 600.

The fixing part 600 comprises the fixing roller 8, the pressure roller 9 and a temperature detection part (not shown). The fixing roller 8 is a roller-like member supported so as to be rotatable around an axis thereof by a driving part (not shown). The fixing roller 8 has a heating part such as a halogen lamp provided therein. The fixing roller 8 fixes an unfixed toner image to a recording medium P by heating the recording medium P and a toner constituting the unfixed toner image borne on the recording medium P and melting the toner. This forms an image based on image information on the recording medium P.

The fixing roller 8 can use a roller-like member comprising, for example, a metal core, an elastic body layer and a surface layer. A metal forming the metal core can be a metal having high thermal conductivity, and examples thereof include aluminum and iron. The shape of the metal core includes a cylindrical shape and a columnar shape. A cylindrical metal core which has small heat discharge from a metal core is preferred.

Material constituting the elastic body layer is not particularly limited so long as it is a material having rubber elasticity. However, a material having excellent heat resistance is preferred. Specific examples of such a material include a silicone rubber, a fluorine rubber and a fluorosilicone rubber. Among them, a silicone rubber having particularly excellent rubber elasticity is preferred.

Material constituting the surface layer is not particularly limited so long as it is a material having excellent heat resistance and durability and low adhesion property of a toner. Examples of the material include a fluorine resin such as PFA (copolymer of tetrafluoroethylene and perfluoroalkyl vinyl ether) and PTFE (polytetrafluoroethylene), and a fluorine rubber.

The pressure roller 9 is a roller-like member provided below the fixing roller 8 in a vertical direction thereof so as to be freely rotatable in a state of coming into pressure-contact with the fixing roller 8. The pressure roller 9 rotates according to rotary drive of the fixing roller 8. A pressure-contact portion between the fixing roller 8 and the pressure roller 9 is called a fixing nip region. The pressure roller 9 is a member which accelerates to fix a toner image to a recording medium P by pressing a toner in a molten state to the recording medium P in the fixing nip region.

The pressure roller 9 can use a roller-like member comprising, for example, a metal core, an elastic body layer and a surface layer. The metal core, elastic body layer and surface layer can use the same materials as in the metal core, elastic body layer and surface layer of the fixing roller 8. Similar to the fixing roller 8, the pressure roller 9 has a heating part provided therein.

The temperature detection part (not shown) is provided in a vicinity of a surface of the fixing roller 8. The temperature detection part detects a surface temperature of the fixing roller 8, and sends the detected result to the control unit part 700 described hereinafter. A plurality of temperature detection parts may be provided, and the temperature detection part may be provided, for example, in a vicinity of a surface of the pressure roller 9.

The image forming apparatus 1 further comprises a control unit part 700. The control unit part 700 is provided in, for example, an upper part of an inner space of the image forming apparatus 1 in a vertical direction thereof, and comprises a memory part, a calculation part and a control part. Various set values mediated through an operation panel (not shown) provided at an upper part of the image forming apparatus 1 in a vertical direction thereof, detection results from sensors (not shown) arranged at various positions in the image forming apparatus 1, image information from external devices, and the like are inputted in the memory part of the control unit part 700. Furthermore, programs performing various processing are written in. The various processing are recording medium judgment processing, attachment amount control processing, fixing temperature control processing, and the like.

The memory part can use memories conventionally used in this field, and examples thereof include a read-only memory (ROM), a random access memory (RAM) and a hard disk drive (HDD). The external device can use electric and electronic devices capable of forming and acquiring image information and capable of electrically connecting to the image forming apparatus 1, and examples thereof include a computer, a digital camera, a television receiver, a video recorder, a DVD (Digital Versatile Disc) recorder, an HDDVD (High-Definition Digital Versatile Disc) recorder, a Blu-ray disc recorder, a facsimile apparatus, and a mobile terminal equipment.

The calculation part picks up various data (image formation order, detection results, image information and the like) written in the memory part and programs for various processing and carries out various judgments. The control part sends a control signal to the apparatus according to judgment results of the calculation part and carries out operation control.

The control part and the calculation part include a processing circuit realized by a microcomputer, a microprocessor and the like equipped with a central processing unit (CPU). The control unit part 700 includes a main power source together with the above-described processing circuit, and the power source feeds electric power to not only the control unit part 700, but also each member in the inside of the image forming apparatus 1.

The photoreactive toner is described below. The photoreactive toner comprises a dye precursor, a color developer and a photocurable composition, as described before. The dye precursor, the color developer and the photocurable composition comprise a dye precursor for yellow, a color developer for yellow and a photocurable composition for yellow, for yellow color formation; a dye precursor for magenta, a color developer for magenta and a photocurable composition for magenta, for magenta color formation; and a dye precursor for cyan, a color developer for cyan and a photocurable composition for cyan, for cyan color formation.

The photocurable composition for yellow, the photocurable composition for magenta and the photocurable composition of cyan are constituted so as to be cured with light having different wavelength, respectively. Light to cure the photocurable composition for yellow is called light for yellow, light to cure the photocurable composition for magenta is called light for magenta, and light to cure the photocurable composition for cyan is called light for cyan.

In the photoreactive toner, the photocurable composition responding to each light is cured by irradiation with any one of light for yellow, light for magenta and light for cyan. This permits the photoreactive toner to develop yellow, magenta, cyan and their mixed colors at the time of heat fixing. A photoreactive toner is classified into a light color formation type toner and a light-non-color formation type toner, depending on how to develop a color.

The light-color formation type toner is a photoreactive toner constituted such that a color corresponding to a photocurable composition is developed at the time of heat fixing by curing of the photocurable composition. The photoreactive toner is constituted such that a color developer is trapped by the photocurable composition, for example, in a state before curing of the photocurable composition. In a state where the color developer is being trapped, the dye precursor cannot approach the color developer even though conducting heat fixing, and those do not react. Therefore, unless the light-color formation type toner is irradiated with any of light for yellow, light for magenta and light for cyan, the light-color formation type toner does not develop a color at the time of heat fixing, and is fixed to a recording medium P in a colorless and transparent state.

In the light-color formation type toner, the color developer trapped can approach the dye precursor at the time of heat fixing by curing of the photocurable composition. This permits the light-color formation type toner to develop a color corresponding to each light curing each photocurable composition. For example, when the light-color formation type toner is irradiated with light for cyan, the light-color formation type toner develops cyan at the time of heat fixing. Furthermore, for example, when the light-color formation type toner is irradiated with light for cyan and light for magenta, the light color-formation type toner develops blue (mixed color of cyan and magenta) at the time of heat fixing.

The light-non-color formation type toner is a photoreactive toner constituted such that the light-non- color formation type toner develops a color different from a color corresponding to a photocurable composition at the time of heat fixing by curing of the photocurable composition. The light-non-color formation type toner is constituted such that the photocurable composition contains a color developer. By this constitution, the light-non-color formation type toner develops a color corresponding to the color developer by heat fixing in a state before curing of the photocurable composition and the color developer, and in a state where the color developer has cured, the color developer does not react with the dye precursor at the time of heat fixing, and, as a result, the light-non-color formation type toner does not develop a color corresponding to the color developer.

For example, when the light-non-color formation type toner is irradiated with light for cyan, the light-non-color formation type toner develops red (mixed color of magenta and yellow) at the time of heat fixing. Furthermore, for example, when the light-non-color formation type toner is irradiated with light for cyan and light for magenta, the light-non-color formation type toner develops yellow at the time of heat fixing. For example, when the light-non-color formation type toner is irradiated with light for yellow, light for magenta and light for cyan, the light-non-color formation type toner does not develop a color at the time of heat fixing, and is fixed to a recording medium P in a colorless and transparent state. In the present embodiment, a light-non-color formation type toner having a melting point of 88° C. and a volume average particle diameter of 5 μm to 20 μm is used as the photoreactive toner. The light non-color formation type toner used in the present embodiment is obtained by dispersing a yellow color formation part which develops yellow, a magenta color formation part which develops magenta, and a cyan color formation part which develops cyan in a thermoplastic binder resin such as a polyester resin.

The yellow color formation part is obtained by dispersing microcapsules having a dye precursor for yellow encapsulated therein, and a photocurable composition for yellow containing a color developer for yellow, in a capsule formed by a known resin. The magenta color formation part is obtained by dispersing microcapsules having a dye precursor for magenta encapsulated therein, and a photocurable composition for magenta containing a color developer for magenta, in a capsule formed by a known resin. The cyan color formation part is obtained by dispersing microcapsules having a dye precursor for cyan encapsulated therein, and a photocurable composition for cyan containing a color developer for cyan, in a capsule formed by a known resin.

An electron donating colorless dye (1) shown below is used as the dye precursor for yellow. An electron donating colorless dye (2) shown below is used as the dye precursor for magenta. An electron donating colorless dye (3) shown below is used as the dye precursor for cyan.

(1)

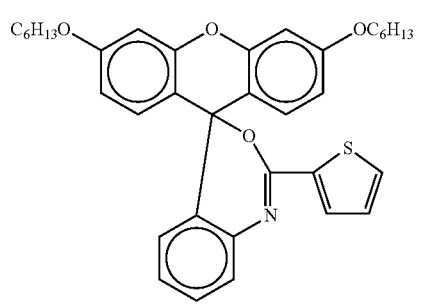

(2)

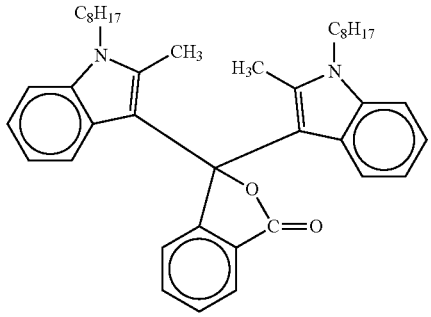

(3)

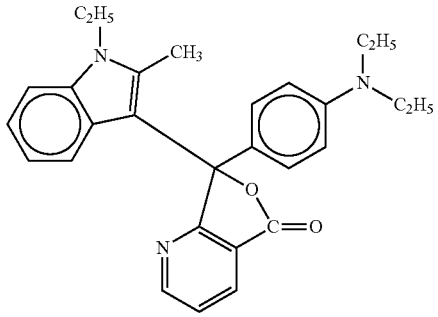

A polymerizable electron accepting compound (4) and a polymerizable electron accepting compound (5), shown below are used as the color developer for yellow. A polymerizable electron accepting compound (6) shown below is used as the color developer for magenta. A polymerizable electron accepting compound (6) shown below is used as the color developer for cyan.

(4)

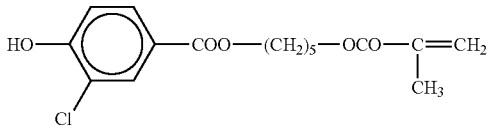

(5)

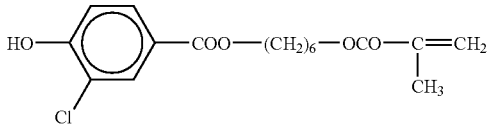

(6)

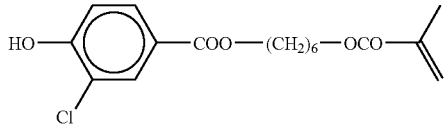

Mixtures of the polymerizable electron accepting compounds (4) and (5), and a heat polymerization inhibitor (ALI) (7), a surfactant (8), hexaaryl biimidazole (9), a nonionic organic dye (10) and an organoboron compound (II), shown below are used as the photocurable composition for yellow.

(7)

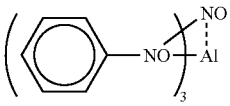

(8)

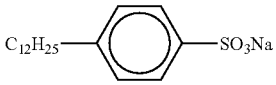

-continued (9)

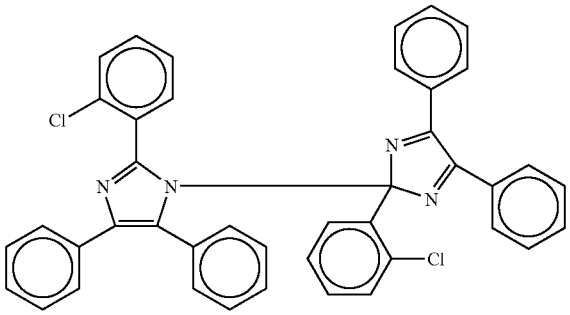

(10)

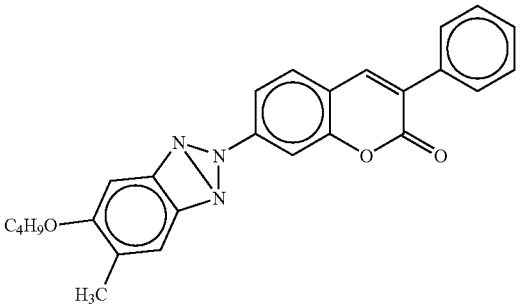

(11)

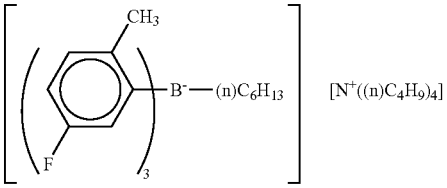

Mixtures of the polymerizable electron accepting compounds (6), and an organoborate compound (12), a spectral sensitizing dye type borate compound (13), an auxiliary agent (14), a surfactant (15) and a surfactant (16), shown below are used as the photocurable composition for magenta.

(12)

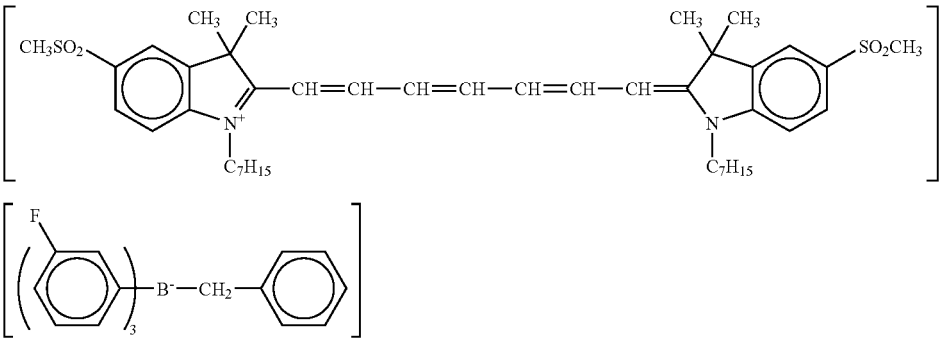

(13)

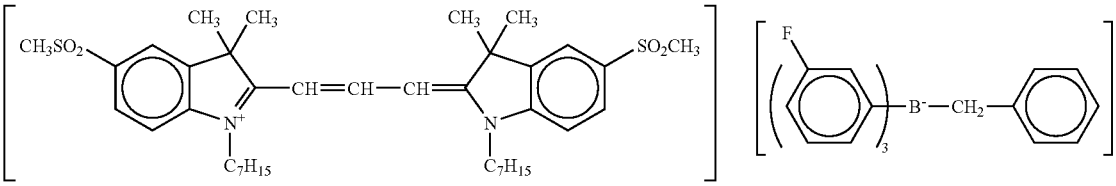

-continued (14)

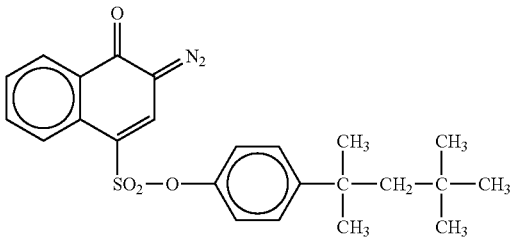

(15)

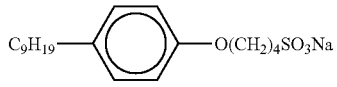

(16)

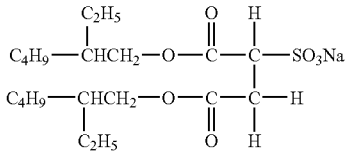

A material obtained by using a spectral sensitizing dye type borate compound (17) shown below in place of the spectral sensitizing dye type borate compound (13) in the photocurable composition for magenta above is used as the photocurable composition for cyan.

(17)

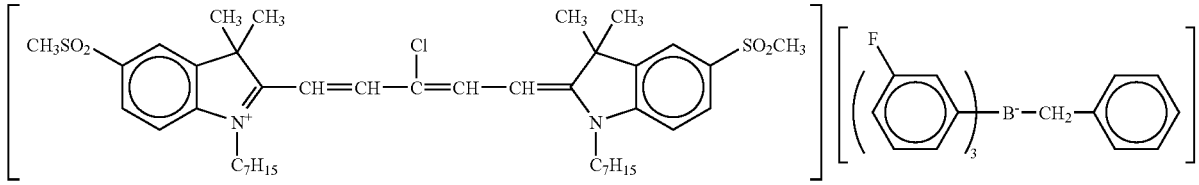

To the light-non-color formation type toner, light for yellow is light $\lambda_1$ emitted from the color formation exposure part 6, light for magenta is light $\lambda_2$ emitted from the color formation exposure part 6, and light for cyan is light $\lambda_3$ emitted from the color formation exposure part 6.

Although the above-described light-non-color formation type toner is used as the photoreactive toner in the present embodiment and other embodiments described hereinafter, a light-color formation type toner may be used in place of the light-non-color formation type toner.

Processing that is conducted by the image forming apparatus 1 according to the first embodiment of the invention is described below. The control unit part 700 conducts processing to control each member constituting the image forming apparatus 1, thereby forming a transparent toner coat layer described hereinafter on an image formed on a recording medium P. This processing is called a transparent toner coat layer formation processing.

Figure 2:
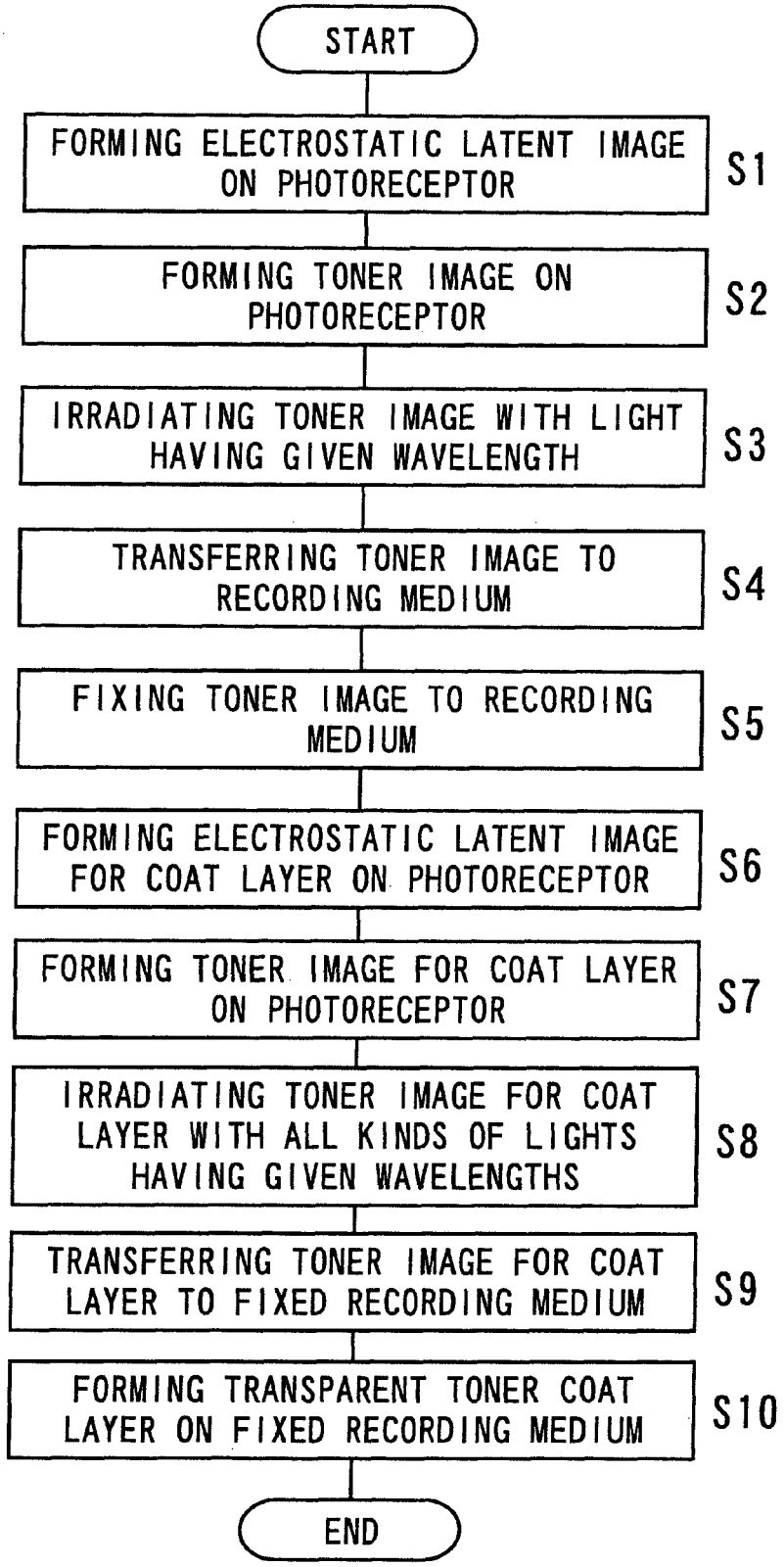
FIG. 2 is a flow chart showing a transparent toner coat layer formation processing.

The transparent toner coat layer formation processing is described in detail below using FIG. 2. FIG. 2 is a flow chart showing a transparent toner coat layer formation processing. When image information is inputted as a digital signal, the control unit part 700 causes an electrostatic latent image based on the image information to be formed on a surface of the photoreceptor drum 2, and takes the processing into step S2 (step S1). In more detail, an electrostatic latent image is formed by irradiating the photoreceptor drum 2 charged by the charging part 3 with laser light from the exposure unit 4.

The control unit part 700 causes a toner image to be formed on the surface of the photoreceptor drum 2 and takes the processing into step 3 (step S2). In more detail, a toner image is formed by feeding a photoreactive toner from the developing part 5 to the electrostatic latent image formed in step S1.

The control unit part 700 causes light having a given wavelength to emit to the toner image on the surface of the photoreceptor drum 2 and takes the processing into step S4 (step S3). In more detail, the toner image on the surface of the photoreceptor drum 2 is irradiated with any one of light $\lambda_1$, light $\lambda_2$ and light $\lambda_3$ by the color formation exposure part 6. By this irradiation, among the photocurable composition contained in the light-non-color formation type toner constituting the toner image, the photocurable composition responding to the light emitted is cured. That is, in step S3, the toner image on the surface of the photoreceptor drum 2 is processed so as to develop a color. The processing such that the light-non-color formation type toner develops black is a processing in which all of light $\lambda_1$, light $\lambda_2$ and light $\lambda_3$ are not emitted.

The control unit part 700 causes the toner image on the surface of the photoreceptor drum 2 to transfer to a recording medium P and takes the processing into step S5 (step S4). In more detail, the toner image is transferred to the recording medium P by sandwiching the recording medium P between the photoreceptor drum 2 and the transfer part 7 in the transfer region.

The control unit part 700 causes the toner image borne on the recording medium P to be fixed to the recording medium P and takes the processing into step S6 (step S5). In more detail, the light-non-color formation type toner borne on the recording medium P is fixed to the recording medium P by heating and melting the same with the fixing part 600. In this case, the color developer in an uncured photocurable composition, contained in the light-non-color formation type toner reacts with the dye precursor responding thereto. This forms an image based on image information on the recording medium P.

The control unit part 700 causes an electrostatic latent image for a transparent toner coat layer (electrostatic latent image for coat layer) to be formed on the surface of the photoreceptor drum 2 based on image information and takes the processing into step S7 (step S6). The electrostatic latent image for a coat layer is the same as the electrostatic latent image formed in step S1 or an electrostatic latent image containing the electrostatic latent image. A method for forming an electrostatic latent image is the same as step S1.

The control unit part 700 causes a toner image for a transparent toner coat layer (toner image for coat layer) to be formed on the surface of the photoreceptor drum 2 and takes the processing into step S8 (step S7). The toner image for a coat layer is a toner image formed by feeding a photoreactive toner to the electrostatic latent image for a coat layer. A method for feeding a toner is the same as step S1.

The control unit part 700 causes all kinds of lights having given wavelengths to be emitted to the toner image for a coat layer on the surface of the photoreceptor drum 2 and takes the processing into step S9 (step S8). In more detail, the toner image for a coat layer on the surface of the photoreceptor drum 2 is irradiated with all of light $\lambda_1$, light $\lambda_2$ and light $\lambda_3$ by the color formation exposure part 6. This is for not causing the light-non-color formation type toner to develop a color at the time of the subsequent fixing by curing all of the photocurable composition contained in the light-non-color formation type toner constituting the toner image for a coat layer. That is, in step S8, the toner image for a coat layer on the surface of the photoreceptor drum 2 is processed so as not to develop a color. In the case of using a light-color formation type toner in place of a light-non-color formation type toner, the processing such that the toner image for a coat layer does not develop a color is a processing that all of light $\lambda_1$, light $\lambda_2$ and light $\lambda_3$ are not emitted.

The control unit part 700 causes the toner image for a coat layer on the surface of the photoreceptor drum 2 to be transferred to the recording medium P to which the toner image has been fixed, and takes the processing into step S10 (step S9). In more detail, the control unit part 700 causes the toner image for a coat layer to be transferred to the recording medium P so as to cover all of the images formed on the recording medium P in step S5. A method, for transferring a toner image for a coat layer is the same as step S4.

The control unit part 700 causes a transparent toner coat layer to be formed on the recording medium P to which the toner image has been fixed (step S10). The transparent toner coat layer is a toner image for a coat layer, fixed to the recording medium P by the fixing part 600. A method for fixing a toner image for a coat layer is the same as step S5. The toner image for a coat layer is processed so as not to develop a color, in step S8. Therefore, the transparent toner coat layer is colorless and transparent. The recording medium P having the transparent toner coat layer formed thereon is discharged to the paper discharge part 18 by the discharge rollers 17.

Thus, the control unit part 700 controls the photoreceptor drum 2, the charging part 3, the exposure unit 4, the developing part 5, the color formation exposure part 6, the transfer part 7, the recording medium feeding part 500 and the fixing part 600 so as to form a transparent toner coat layer which is a colorless and transparent toner layer by transferring the photoreactive toner (toner image for a coat layer) having been processed so as not to develop a color to the recording medium P to which the toner image having been processed so as to develop a color has been fixed, and fixing the photoreactive toner (toner image for a coat layer) having been processed so as not to develop a color, to an image formed on the recording medium P.

Figure 3:
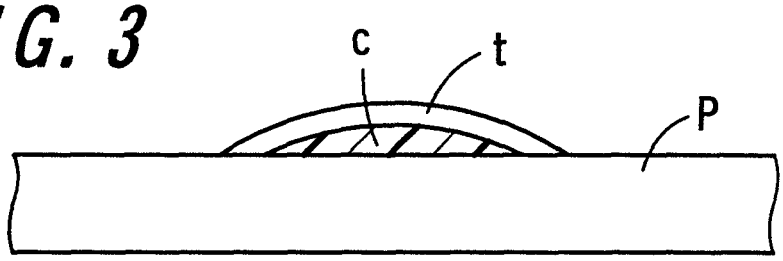
FIG. 3 is a view showing a recording medium having a transparent toner coat layer formed thereon.

FIG. 3 is a view showing a recording medium P having a transparent toner coat layer t formed thereon. In FIG. 3, an image c formed on the recording medium P is indicated by an oblique line part. As shown in FIG. 3, the transparent toner coat layer t is formed so as to cover the image c. Therefore, the image c has excellent rubbing resistance, waterproof property and storage stability.

The term "excellent rubbing resistance" used herein means that the image c is difficult to be peeled from the recording medium P even though the toner fixed to the recording medium P is rubbed. A major part of the toner constituting the image c is covered with a toner constituting the transparent toner coat layer t, and is therefore not directly rubbed. As a result, the image c is difficult to be peeled from the recording medium P.

The term "excellent waterproof property" means that even though the recording medium P is wetted by water or the like, color of the image c is difficult to be lost, and even though the recording medium P is wetted to generate wrinkles thereon, the images is difficult to be peeled. The reason that the image c has excellent waterproof property is due to the same action as excellent rubbing resistance.

The term "excellent storage stability" means that even though a long period of time is passed after formation of an image, the image c is difficult to fade and discolor, and even though the image c is contacted with another object over a long period of time, color of the image c is difficult to transfer to the other object. Excellent storage stability of the image c is due to the same action as excellent rubbing resistance, and additionally the action that a toner constituting the image c is difficult to contact with light and outside air and is difficult to modify.

Thus, according to the image forming apparatus 1, formation of the image c and formation of the transparent toner coat layer can be performed by one developing part 5. Consequently, the image c having excellent rubbing resistance, waterproof property and storage stability can be formed by a downsized image forming apparatus 1.

The transparent toner coat layer t may be formed on only the image c in a range and a shape, completely coinciding with the image c in a face direction of the recording medium P. However, the transparent toner coat layer t is preferably formed on the image c and the recording medium P in a form containing the image c and wider than the image c, as shown in FIG. 3. The image c has a thickness. Therefore, even though the transparent toner coat layer t has a range completely coinciding with the image c, a part of a toner constituting the image c is exposed. In the case of forming an electrostatic latent image for a coat layer such that the transparent toner coat layer t completely coincides with the image c, where error is generated at a transfer position in the transfer of the toner image for a coat layer, a part of the toner constituting the image c is exposed.

Therefore, the transparent toner coat layer t is formed 1 dot or more and more preferably 3 to 10 dots, wider than the image c in a face direction of the recording medium P. The transparent toner coat layer t may be formed on the entire surface of the recording medium P on which the image c is formed. This can further suppress a part of a toner constituting the image c from exposing. In the case where the transparent toner coat layer t is formed wider than the image c, the control unit part 700 prepares fresh image information by expanding a contour of an image in image information corresponding to the image c 1 dot or more, and causes an electrostatic latent image for a coat layer to form on the basis of the fresh image information.

In the present embodiment, fixing of a toner image for forming an image and fixing of a toner image for a coat layer for forming a transparent toner coat layer are conducted, respectively. That is, although the image forming apparatus 1 is an apparatus constituted so as to conduct the fixing two times, the image forming apparatus 1 may be constituted so as to form an image and a transparent toner coat layer by one time fixing by transferring the toner image for a coat layer onto an unfixed toner image. However, a method of conducting fixing two times is preferred such that a toner constituting a transparent toner coat layer does not permeate an image. When the toner constituting the transparent toner coat layer permeates an image, thickness of the transparent toner coat layer is decreased. Even in the case where the toner constituting the transparent toner coat layer has permeated an image, a toner constituting an image is strongly fixed to a recording medium P by an anchor effect due to a toner permeated. As a result, rubber resistance of an image is maintained.

In the case of an image forming apparatus having a constitution conducting fixing two times as in the present embodiment, the control unit part 700 preferably controls the fixing part 600 such that a first fixing temperature T1 which is a temperature of the fixing part 600 when fixing a toner image to the recording medium P is higher than a second fixing temperature T2 which is a temperature of the fixing part 600 when forming a transparent toner coat layer.

Such a control is conducted based on a temperature detected by a temperature detection part provided in the fixing part 600. For example, the first fixing temperature T1 is controlled to 150° C. to 220° C. and the second fixing temperature T2 is controlled to 130° C. to 170° C.

By controlling the fixing part 600 thus, even in the case where the recording medium P reached the fixing part 600 in the state that temperature is increased due to storage heat by the first fixing, the second fixing temperature T2 in the second fixing is lower than the first fixing temperature T1. As a result, high temperature offset is not generated. Furthermore, the transparent toner coat layer is formed at the second fixing temperature T2 which is lower than the first fixing temperature T1 when forming an image. This can suppress permeation of a toner constituting the transparent toner coat layer into an image.

The image forming apparatus 1 has the recording medium reversing part which reverses a recording medium P by a switchback mechanism as described before. This not only permits to conduct double face printing by a simple constitution, but permits to form a transparent toner coat layer on a side of the recording medium P opposite the side on which an image is formed in the case of one-side printing.

In the case where an image is formed on only one side and a transparent toner coat layer is formed on both sides, for example, each transparent toner coat layer formed on both sides forms a transparent toner coat layer so as to face each other with the recording medium P interposed therebetween. Thus, by forming a transparent coat layer on both sides, rubbing resistance, waterproof property and storage stability of the image formed on the recording medium P can further be improved.

An image forming apparatus 1*a* which is a second embodiment of the image forming apparatus according to the first aspect of the invention is described below. The image forming apparatus 1*a* comprises a toner image forming part 200 comprising a first photoreceptor, a second photoreceptor, a first developing device, a second developing device and a second photoreceptor separating/contacting part, a recording medium feeding part 500, a fixing part 600 and a control unit part 700. The image forming apparatus 1*a* has the same constitution as the image forming apparatus 1 except for equipped with the toner image forming part 200 in place of the toner image forming part 100. Therefore, descriptions regarding the recording medium feeding part 500, the fixing part 600 and the control unit part 700 are omitted.

Figure 4:
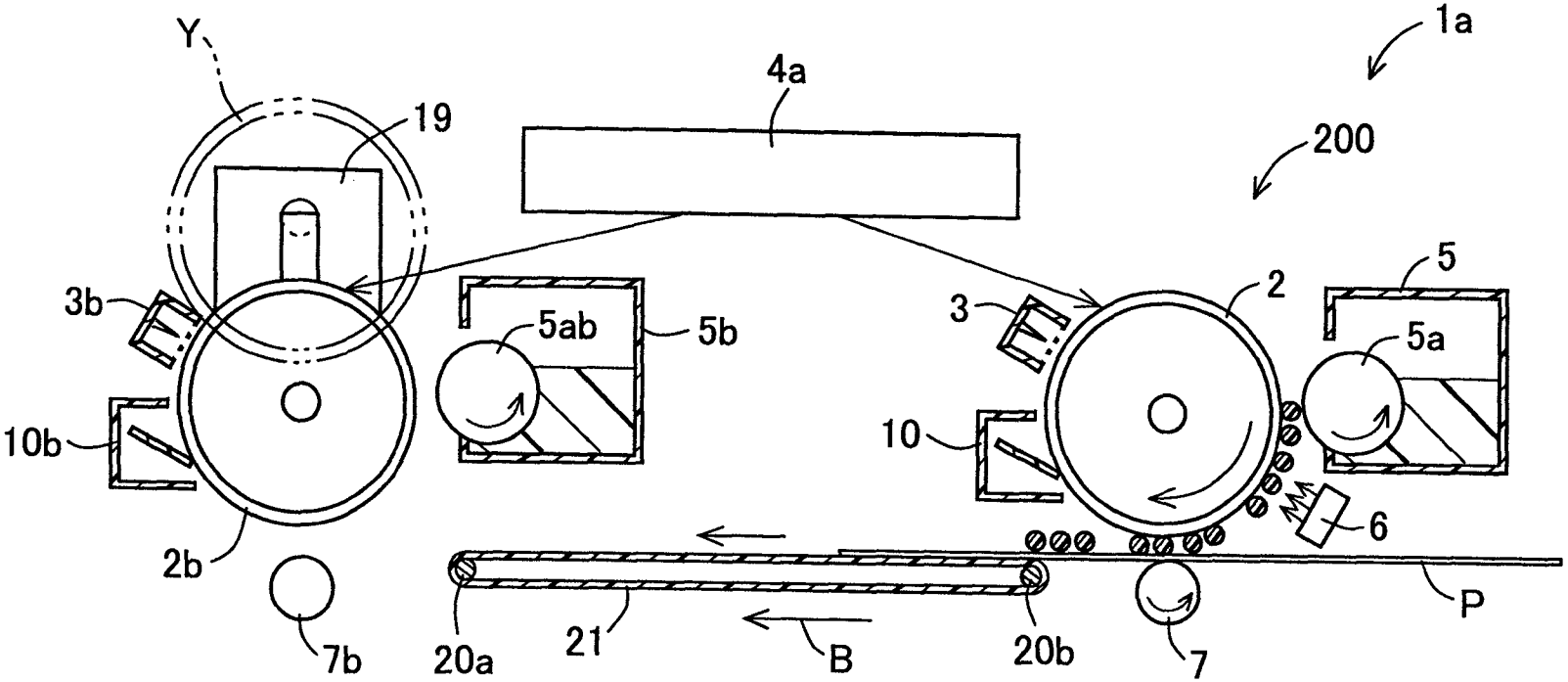
FIG. 4 is a schematic view schematically showing a cross-section of an image forming apparatus.

FIG. 4 is a schematic view schematically showing a cross-section of the image forming apparatus 1*a*. In FIG. 4, only the toner image forming part 200 which is a main part of the image forming apparatus 1*a* is shown, and other members are omitted. The toner image forming part 200 comprises photoreceptor drums 2 and 2*b*, charging parts 3 and 3*b*, an exposure unit 4*a*, developing parts 5 and 5*b*, a color formation exposure part 6, transfer parts 7 and 7*b*, drum cleaners 10 and 10*b*, a second photoreceptor separating/contacting part 19, supporting rollers 20*a* and 20*b*, and a conveying belt 21.

In the present embodiment, the photoreceptor drum 2 is the first photoreceptor described before. The photoreceptor drum 2*b* is the second photoreceptor described before. The second photoreceptor separating/contacting part 19 is the second photoreceptor separating/contacting part described before. The charging parts 3 and 3*b* are the charging device described before. The exposure unit 4*b* is the exposure device described before. The developing part 5 is the first developing device described before. The developing part 5*b* is the second developing device described before. The color formation exposure part 6 is the color formation exposure device described before. The transfer parts 7 and 7*b*, the supporting rollers 20*a* and 20*b*, the conveying belt 21 and the recording medium feeding part 500 are the transfer device described before. The fixing part 600 is the fixing device described before. The control unit part 700 is the control device described before.

The photoreceptor 2, the charging part 3, the developing part 5, the color formation exposure part 6, the transfer part 7 and the drum cleaner 10 have the same constitution as the respective members used in the image forming apparatus 1, and the explanations of those are omitted. However, in order to distinguish from a second transfer region described hereinafter between the photoreceptor drum 2*b* and the transfer part 7*b*, a transfer region between the photoreceptor drum 2 and the transfer part 7 is called a first transfer region in the present embodiment.

The photoreceptor drum 2*b* is a roller-like member provided at a downstream side with respect to the photoreceptor drum 2 in a conveyance direction shown in the arrow B. The photoreceptor drum 2*b* is supported by the second photoreceptor separating/contacting part 19 described hereinafter. The photoreceptor drum 2*b* can use the same member as the photoreceptor drum 2.

The charging part 3*b* is provided to face the photoreceptor drum 2*b* along a longitudinal direction of the photoreceptor drum 2*b* with a given distance to a surface of the photoreceptor drum 2*b*. The charging part 3*b* can use the same member as the charging part 3.

The exposure unit 4*a* is a laser scanning unit which emits laser light to the respective surfaces of the photoreceptor drums 2 and 2*b* in a charged state. The exposure unit 4*a* emits laser light according to image information of each color other than black to the surface of the photoreceptor drum 2, thereby forming an electrostatic latent image corresponding to image information of each color other than black on the surface of the photoreceptor drum 2. Furthermore, the exposure unit 4*a* emits laser light according to image information of black to the surface of the photoreceptor drum 2*b*, thereby forming an electrostatic latent image corresponding to image information of black on the surface of the photoreceptor drum 2*b*. The exposure unit 4*a* can use the same member as the exposure unit 4.

The developing part 5*b* is a container-like member provided so as to face the photoreceptor drum 2*b*. The developing part 5*b* stores a black developer in its inner space. The black developer is a one-component developer consisting of a black toner which is a toner for forming a black image, or a two-component developer comprising the black toner and the known carrier. The black toner comprises, for example, a polyester resin as a binder resin, carbon black as a colorant, and a metal alkyl salicylate as a charge control agent.

The developing part 5*b* has an opening on a side facing the photoreceptor drum 2*b*. The developing part 5*b* is equipped with a developing roller 5*ab*, and the developing roller 5*ab* is provided such that a part thereof is projected from the opening formed on the side facing the photoreceptor 2*b* toward the outside of the developing part 5*b* and is close to the surface of the photoreceptor drum 2*b*. The developing roller 5*ab* can use the same member as the developing roller 5*a*. According to the developing part 5*b*, a black developer borne on the surface of the developing roller 5*ab* is fed to an electrostatic latent image on the surface of the photoreceptor drum 2*b*. This forms a toner image (black toner image) comprising a black toner on the surface of the photoreceptor drum 2*b*.

The transfer part 7*b* is a roller-like member provided so as to face the photoreceptor drum 2*b*. The transfer part 7*b* sandwiches a recording medium P sent from a conveying belt 21 described hereinafter between the transfer part 7*b* and the photoreceptor drum 2*b*, thereby transferring a black toner image on the surface of the photoreceptor drum 2*b* to the recording medium P in a region (second transfer region) sandwiched between the photoreceptor drum 2*b* and the transfer part 7*b*. The recording medium P having a black toner image transferred thereto is sent to the fixing part 600 by the transfer part 7*b*. The transfer part 7*b* can use the same member as the transfer part 7.

The drum cleaner 10*b* is a member which removes and collects a residual black toner on the surface of the photoreceptor drum 2*b* after the black toner image on the surface of the photoreceptor drum 2*b* has been transferred to the recording medium P. The drum cleaner 10*b* can use the same member as the drum cleaner 10.

The conveying belt 21 is an endless belt-like member supported around the supporting rollers 20*a* and 20*b* with tension. The conveying belt 21 can use, for example, a semiconductive polycarbonate belt having a thickness of 200 μm. The conveying belt 21 sends the recording medium P sent from the first transfer region to the second transfer region by moving the recording medium P due to the rotation thereof while bearing the same thereon. Thus, the transfer devices 7 and 7*b* and the conveying belt 21 are constituted such that after transferring a toner image (photoreactive toner image) comprising a photoreactive toner to the recording medium P by conveying the recording medium P to the photoreceptor drum 2, the recording medium P is conveyed to the photoreceptor drum 2, thereby transferring a black toner image to the recording medium P.

The supporting rollers 20*a* and 20*b* are a roller-like member provided so as to be rotatable around an axis thereof by a driving part (not shown). The supporting rollers 20*a* and 20*b* use, for example, an aluminum cylindrical body (pipe-like roller).

The second photoreceptor separating/contacting part 19 is a member which supports the photoreceptor drum 2*b* and moves the photoreceptor drum 2*b* to a position of a dashed-two dotted chain line Y shown in FIG. 4. The position of the dashed-two dotted line Y is a position at which the photoreceptor drum 2*b* sufficiently separates from transfer part 7*b*, and is a position that even though the recording medium P is sent to the second transfer region, the black toner on the surface of the photoreceptor drum 2*b* is not transferred to the recording medium P. That is, the second photoreceptor separating/contacting part 19 permits to separate/contact the photoreceptor drum 2*b* and the transfer part 7*b*.

In the image forming apparatus 1*a* constituted as above, the control unit part 700 controls each member so as to form the black color image by a black toner in the case where an image to be formed on the recording medium P is a full color image containing a black color image. That is, the control unit part 700 controls such that a photoreactive toner does not develop a black color and controls such that a black color image is formed by a black toner, thereby forming a desired full color image on the recording medium P.

In this case, a photoreactive toner image processed so as to develop a color first is transferred to the recording medium P, and a black toner image is then transferred to the recording medium P. The recording medium P having the photoreactive toner image processed so as to develop a color and the black toner image transferred thereto is sent to the fixing part 600, and both toner images are fixed to the recording medium P. This forms an image on the recording medium P. Thereafter, similar to the first embodiment, a transparent toner coat layer is formed on an image formed on the recording medium P, and the recording medium P is discharged to the paper discharge part 18. The action that rubbing resistance, waterproof property and storage stability of the image is improved by the formation of a transparent toner coat layer on an image is the same as in the first embodiment.

In the case where a black color image is not contained in an image to be formed, only a photoreactive toner image processed so as to develop a color is transferred to the recording medium P, similar to the first embodiment. The recording medium P to which the photoreactive toner image processed so as to develop a color has been transferred is sent to the fixing part 600, and the photoreactive toner image is fixed to the recording medium P. This forms an image on the recording medium P. Thereafter, similar to the first embodiment, a transparent toner coat layer is formed on the image formed on the recording medium P, and the recording medium P is discharged to the paper discharge part 18.

In the case where an image to be formed consists of a black color image, that is, in the case of forming a monochrome image, only a black toner image is transferred to the recording medium P. The recording medium P to which the black toner image has been transferred is sent to the fixing part 600, and the black toner image is fixed to the recording medium P. This forms an image on the recording medium P. Thereafter, similar to the first embodiment, a transparent toner coat layer is formed on the image formed on the recording medium P, and the recording medium P is discharged to the paper discharge part 18.

Thus, the image forming apparatus 1*a* has a black toner, in addition to a photoreactive toner, in order to form a black color image. This can form a black color image definitely, as compared with the case of forming a black color image by a photoreactive toner having developed a black color.

In the present embodiment, after the photoreactive toner image has been transferred to the recording medium P, a black toner image is transferred to the recording medium P and both toner images are then fixed thereto, as described above. That is, the photoreceptor drum 2*b* is provided at a downstream side with respect to the photoreceptor drum 2 in a conveyance direction. Therefore, even in the case of intending to form an image containing a black color image, the photoreceptor drum 2 does not contact an unfixed black toner image borne on the recording medium P. This can prevent a black toner from incorporating into the developing part 5.

The reason why the image forming apparatus 1*a* is constituted like this is that a photoreactive toner stored in the developing part 5 is used to not only the formation of a full color image, but the formation of a transparent toner coat layer. That is, it is preferred that a black toner does not incorporate into a transparent toner coat layer.

The photoreceptor drum 2*b* is provided such that the photoreceptor drum 2*b* can be separated from the transfer part 7*b* by the second photoreceptor separating/contacting part 19 as described above. In the present embodiment, the control unit part 700 controls the second photoreceptor separating/contacting part 19 such that the photoreceptor drum 2*b* and the transfer part 7*b* are separated with each other, except when transferring a black toner image to the recording medium P. Therefore, the recording medium P does not contact the photoreceptor drum 2*b* during the period until a transparent toner coat layer is formed on an image after the image has been formed on the recording medium P. This can prevent the recording medium P from contamination due to that a black toner which was not collected by the drum cleaner 10*b* and remained on the surface of the photoreceptor drum 2*b* contacts the recording medium P.

An image forming apparatus 1*b* which is a third embodiment of the image forming apparatus according to the first aspect of the invention is described below. The image forming apparatus 1*b* comprises a toner image forming part 300 comprising a first photoreceptor, a second photoreceptor, a first developing device, a second developing device, a first photoreceptor separating/contacting part and a second photoreceptor separating/contacting part, a recording medium feeding part 500, a fixing part 600 and a control unit part 700. The image forming apparatus 1*b* has the same constitution as the image forming apparatus 1, except for being equipped with the toner image forming part 300 in place of the toner image forming part 100. Therefore, descriptions regarding the recording medium feeding part 500, the fixing part 600 and the control unit part 700 are omitted.

Figure 5:
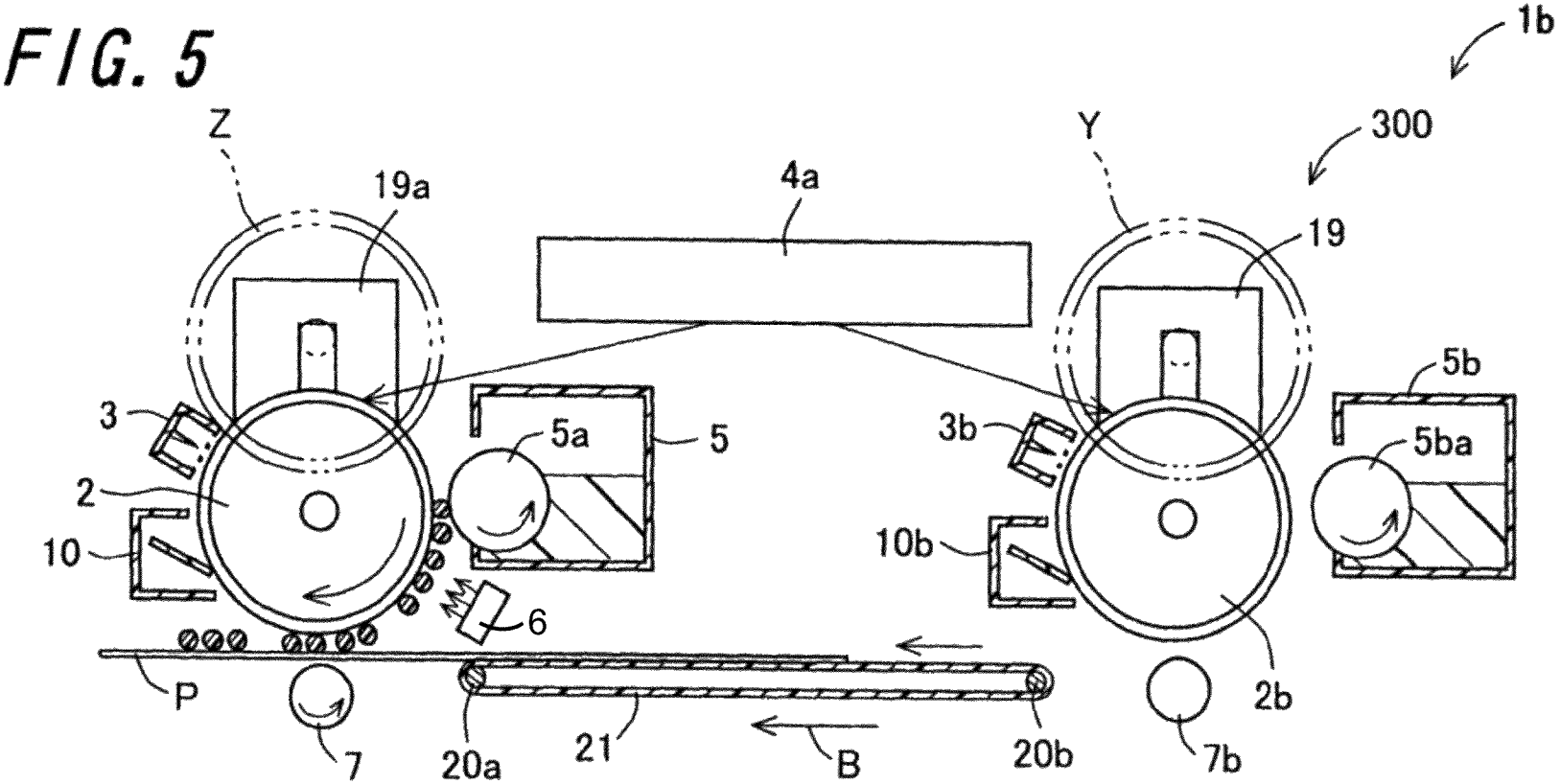
FIG. 5 is a schematic view schematically showing a cross-section of an image forming apparatus.

FIG. 5 is a schematic view schematically showing a cross-section of the image forming apparatus 1*b*. In FIG. 5, only the toner image forming part 300 which is a main part of the image forming apparatus 1*b* is shown, and other members are omitted. The toner image forming part 300 comprises photoreceptor drums 2 and 2*b*, charging parts 3 and 3*b*, an exposure unit 4*a*, developing parts 5 and 5*b*, color formation exposure part 6, transfer parts 7 and 7*b*, drum cleaners 10 and 10*b*, a first photoreceptor separating/contacting part 19*a*, a second photoreceptor separating/contacting part 19, supporting rollers 20*a* and 20*b*, and a conveying belt 21.

In the present embodiment, the photoreceptor drum 2 is the first photoreceptor described above. The first photoreceptor separating/contacting part 19*a* is the first photoreceptor separating/contacting part described above. The photoreceptor drum 2*b* is the second photoreceptor described above. The second photoreceptor separating/contacting part 19 is the second photoreceptor separating/contacting part described above. The charging parts 3 and 3*b* are the charging device described above. The exposure unit 4*a* is the exposure device described above. The developing part 5 is the first developing device described above. The developing part 5*b* is the second developing device described above. The color formation exposure part 6 is the color formation exposure device described above. The transfer parts 7 and 7*b*, the supporting roller 20*a* and 20*b*, the conveying belt 21 and the recording medium feeding part 500 are the transfer device described above. The fixing part 600 is the fixing, device described above. The control unit part 700 is the control device described above.

The image forming apparatus 1*b* is the same as the image forming apparatus 1*a* which is the second embodiment, except that arrangement of each member in the toner image forming part 300 differs from arrangement of each member in the toner image forming part 200, and the image forming apparatus 1*b* is equipped with the first photoreceptor separating/contacting part 19*a*. Therefore, detailed description of each member other than the first photoreceptor separating/contacting part 19*a* is omitted.

Each member in the toner image forming part 300 is arranged such that after transferring a black toner image to the recording medium P by conveying the recording medium P to the photoreceptor drum 2*b*, the recording medium P is conveyed to the photoreceptor drum 2, thereby transferring a photoreactive toner image to the recording medium P. That is, the photoreceptor drum 2 is provided at a downstream side with respect to the photoreceptor drum 2*b* in a conveyance direction shown in the arrow B.

The first photoreceptor separating/contacting part 19*a* is a member which supports the photoreceptor drum 2 and moves the photoreceptor drum 2 to a position of a dashed-two dotted line Z shown in FIG. 5. The position of a dashed-two dotted line Z is a position at which the photoreceptor drum 2 sufficiently separates from the transfer part 7, and is a position at which the photoreactive toner on the surface of the photoreceptor drum 2 is not transferred to the recording medium P even though the recording medium P is sent to the first transfer region. That is, the first photoreceptor separating/contacting part 19*a* can make the photoreceptor drum 2 and the transfer part 7 separate and contact.

In the image forming apparatus 1*b* constituted as above, in the case where an image to be formed on the recording medium P is a full color image containing a black color image, the control unit part 700 controls each member so as to form the black color image by a black toner, similar to the image forming apparatus 1*a* which is the second embodiment. That is, the control unit part 700 carries out control such that a photoreactive toner does not develop a color and carries out control such that a black color image is formed by a black toner, thereby a desired full color image is formed on the recording medium P.

In this case, a black toner image is first transferred to the recording medium P, and a photoreactive toner image processed so as to develop a color is then transferred thereto. The recording medium P having transferred thereto the photoreactive toner image processed so as to develop a color and the black toner image is sent to the fixing part 600, and both toner images are fixed to the recording medium P. This forms an image on the recording medium P. Thereafter, similar to the first and second embodiments, a transparent toner coat layer is formed on the image formed on the recording medium P, and the recording medium P is discharged to the paper discharge part 18. The action that rubbing resistance, waterproof property and storage stability of the image is improved by the formation of the transparent toner coat layer on an image is the same as in the first and second embodiments.

In the case where a black color image is not contained in an image to be formed, only a photoreactive toner image processed so as to develop a color is transferred to the recording medium P, similar to the first and second embodiments. The recording medium P having transferred thereto the photoreactive toner image processed so as to develop a color is sent to the fixing part 600, and the photoreactive toner image is fixed to the recording medium P. This forms an image on the recording medium P. Thereafter, similar to the first and second embodiments, a transparent toner coat layer is formed on the image formed on the recording medium P, and the recording medium P is discharged to the paper discharge part 18.

In the case where an image to be formed consists of a black color image, that is, in the case of forming a monochrome image, a toner image for a coat layer is transferred to the recording medium P after the black toner image has been transferred to the recording medium P and before the black toner image is fixed to the recording medium P. Thereafter, the recording medium P is sent to the fixing part 600, and formation of an image by the black toner image and formation of a transparent toner coat layer are conducted by one time fixing. The recording medium P having formed thereon the image and the transparent toner coat layer is discharged to the paper discharge part 18.

Thus, in the present embodiment, the control unit part 700 controls each member such that fixing of a black toner image to a recording medium P and formation of a transparent toner coat layer are conducted at once. This allows a monochrome image coated with the transparent toner coat layer to form in a relatively short period of time.

In the case of forming a monochrome image, the control unit part 700 may control each member such that after fixing a black toner image to the recording medium P, a toner image for a coat layer is transferred to the recording medium P, and a transparent toner coat layer is formed thereon. In this case, the control unit part 700 controls the first photoreceptor separating/contacting part 19 such that the photoreceptor drum 2 and the transfer part 7 are separated with each other, except when transferring the toner image for a coat layer to the recording medium P. This prevents the photoreceptor drum 2 from being contacted with an unfixed black toner image borne on the recording medium P. As a result, a black toner is prevented from incorporating into the developing part 5.

As described above, the photoreceptor drum 2*b* is provided so as to be separated from the transfer part 7*b* by the second photoreceptor separating/contacting part 19. In the present embodiment, the control unit part 700 controls the second photoreceptor separating/contacting part 19 such that the photoreceptor drum 2*b* and the transfer part 7*b* are separated with each other, except when transferring a black toner image to the recording medium P. Therefore, the recording medium P does not contact the photoreceptor drum 2*b* during the period until a transparent toner coat layer is formed on an image after the image has been formed on the recording medium P. This can prevent contamination of the recording medium P due to contact of a black toner not collected by the drum cleaner 10*b* and remained on the surface of the photoreceptor drum 2*b*, with the recording medium P.

An image forming apparatus according to a second aspect of the invention is described below. The image forming apparatus according to the second aspect of the invention comprises a photoreceptor, a charging device, an exposure device, a chromatic toner developing device, a transparent toner developing device, a chromatic toner image transfer device, a transparent toner image transfer device, a fixing device, and a control device. An image forming apparatus 1*c* which is an embodiment of the image forming apparatus according to the second aspect of the invention is described below. The image forming apparatus 1*c* has the same constitution as the image forming apparatus 1, except that the image forming apparatus 1*c* is equipped with a toner image forming part 400 in place of the toner image forming part 100. Therefore, descriptions regarding the recording medium feeding part 500, the fixing part 600 and the control unit part 700 are omitted.

Figure 6:
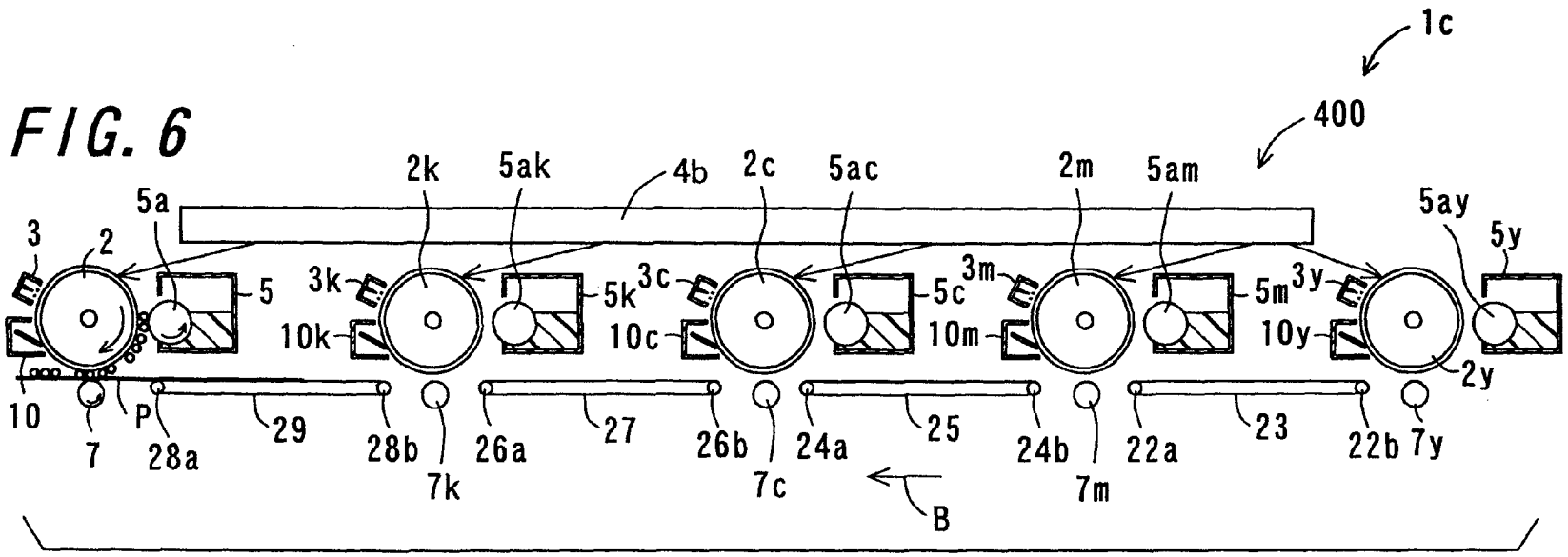
FIG. 6 is a schematic view schematically showing a cross-section of an image forming apparatus.

FIG. 6 is a schematic view schematically showing a cross-section of the image forming apparatus 1*c*. In FIG. 6, only the toner image forming part 400 which is a main part of the image forming apparatus 1*c* is shown, and other members are omitted. The toner image forming part 400 comprises photoreceptor drums 2, 2*y*, 2*m*, 2*c* and 2*k*, charging parts 3, 3*y*, 3*m*, 3*c* and 3*k*, an exposure unit 4*b*, developing parts 5, 5*y*, 5*m*, 5*c* and 5*k*, transfer parts 7, 7*y*, 7*m*, 7*c* and 7*k*, drum cleaners 10, 10*y*, 10*m*, 10*c* and 10*k*, supporting rollers 22*a*, 22*b*, 24*a*, 24*b*, 26*a*, 26*b*, 28*a* and 28*b*, and conveying belts 23, 25, 27 and 29.

In the present embodiment, the photoreceptor drums 2, 2*y*, 2*m*, 2*c* and 2*k* are the photoreceptor described above. The charging parts 3, 3*y*, 3*m*, 3*c* and 3*k* are the charging device described above. The exposure unit 4*b* is the exposure device described above. The developing part 5 is the transparent toner developing device described above. The developing parts 5*y*, 5*m*, 5*c* and 5*k* are the chromatic toner developing device described above. The transfer parts 7, 7*y*, 7*m*, 7*c* and 7*k*, the supporting rollers 22*a*, 22*b*, 24*a*, 24*b*, 26*a*, 26*b*, 28*a* and 28*b*, the conveying belts 23, 25, 27 and 29, and the recording medium feeding part 500 are the chromatic toner image transfer device described above, and are the transparent toner image transfer device described above. The fixing part 600 is the fixing device described above. The control unit part 700 is the control device described above.

The photoreceptor drum 2, the charging part 3, the developing part 5, the transfer part 7 and the drum cleaner 10 have the same constitution as the respective members used in the image forming apparatus 1. Therefore, descriptions regarding those members are omitted. However, a toner stored in the developing part 5 is not a photoreactive toner, but a toner (transparent toner) used only for forming a transparent toner coat layer which is a colorless and transparent toner layer. The transparent toner comprises, for example, a polyester resin as a binder resin and a metal alkyl salicylate as a charge control agent.

In the present embodiment, a transfer region between the photoreceptor drum 2 and the transfer part 7 is called a first transfer region. The transfer part 7 transfers a toner image (transparent toner image) comprising a transparent toner, on the surface of the photoreceptor drum 2 to the recording medium P in the first transfer region by sandwiching the recording medium P sent from the conveying belt 29 described hereinafter between the transfer part 7 and the photoreceptor drum 2. The recording medium P having transferred thereto the transparent toner image is sent to the fixing part 600 by the transfer part 7.

The photoreceptor drums 2*y*, 2*m*, 2*c* and 2*k* are a roller-like member provided at an upstream side with respect to the photoreceptor drum 2 in a conveyance direction shown in the arrow B. The photoreceptor drums 2*y*, 2*m*, 2*c* and 2*k* are provided from the upstream side of a conveyance direction in this order. The photoreceptor drums 2*y*, 2*m*, 2*c* and 2*k* can use the same member as the photoreceptor drum 2.

The charging part 3*y* is arranged to face the photoreceptor drum 2*y* with a given space to the surface of the photoreceptor drum 2*y* along a longitudinal direction of the photoreceptor drum 2*y*. The charging part 3*m* is arranged to face the photoreceptor drum 2*m* with a given space to the surface of the photoreceptor drum 2*m* along a longitudinal direction of the photoreceptor drum 2*m*. The charging part 3*c* is arranged to face the photoreceptor drum 2*c* with a given space to the surface of the photoreceptor drum 2*c* along a longitudinal direction of the photoreceptor drum 2*c*. The charging part 3*k* is arranged to face the photoreceptor drum 2*k* with a given space to the surface of the photoreceptor drum 2*k* along a longitudinal direction of the photoreceptor drum 2*k*. The charging parts 3*y*, 3*m*, 3*c* and 3*k* can use the same member as the charging part 3.

The exposure unit 4*b* is a laser scanning unit which emits laser light to the respective surfaces of the photoreceptor drums 2, 2*y*, 2*m*, 2*c* and 2*k* in a charged state. The exposure unit 4*b* emits laser light to the surface of the photoreceptor drum 2 according to image information of each color, thereby forming an electrostatic latent image corresponding to image information of each color on the surface of the photoreceptor drum 2. Furthermore, the exposure unit 4*b* emits laser light to the surface of the photoreceptor drum 2*y* according to image information of yellow, thereby forming an electrostatic latent image corresponding to image information of yellow on the surface of the photoreceptor drum 2*y*. The exposure unit 4*b* emits laser light to the surface of the photoreceptor drum 2*m* according to image information of magenta, thereby forming an electrostatic latent image corresponding to image information of magenta on the surface of the photoreceptor drum 2*m*.

Furthermore, the exposure unit 4*b* emits laser light to the surface of the photoreceptor drum 2*c* according to image information of cyan, thereby forming an electrostatic latent image corresponding to image information of cyan on the surface of the photoreceptor drum 2*c*. The exposure unit 4*b* emits laser light to the surface of the photoreceptor drum 2*k* according to image information of black, thereby forming an electrostatic latent image corresponding to image information of black on the surface of the photoreceptor drum 2*k*. The exposure unit 4*b* can use the same member as the exposure unit 4.

The developing part 5*y* is a container-like member provided so as to face the photoreceptor drum 2*y*. The developing part 5*y* stores a yellow developer in its inner space. The yellow developer is a one-component developer consisting of a yellow toner which is a chromatic toner for forming a yellow image, or a two-component developer comprising a yellow toner and a known carrier. The yellow toner comprises, for example, a polyester resin as a binder resin, C.I. Pigment Yellow 74 as a colorant, and a metal alkyl salicylate as a charge control agent.

The developing part 5*y* has an opening formed on the side facing the photoreceptor drum 2*y*. The developing part 5*y* is equipped with a developing roller 5*ay*, and the developing roller 5*ay* is provided such that a part thereof projects toward the outside of the developing part 5*y* from the opening formed on the side facing the photoreceptor drum 2*y* and is close to the surface of the photoreceptor drum 2*y*. The developing roller 5*ay* can use the same member as the developing roller 5*a*. According to the developing part 5*y*, the yellow developer borne on the surface of the developing roller 5*ay* is fed to an electrostatic latent image on the surface of the photoreceptor drum 2*y*. This forms a toner image (yellow toner image) comprising a yellow toner on the surface of the photoreceptor drum 2*y*.

The developing part 5*m* is a container-like member provided so as to face the photoreceptor drum 2*m*. The developing part 5*m* stores a magenta developer in its inner space. The magenta developer is a one-component developer consisting of a magenta toner which is a chromatic toner for forming an image of magenta, or a two-component developer comprising the magenta toner and the known carrier. The magenta toner comprises, for example, a polyester resin as a resin binder, C.I. Pigment Red 122 as a colorant, and a metal alkyl salicylate as a charge control agent.

The developing part 5*m* has an opening formed on the side facing the photoreceptor drum 2*m*. The developing part 5*m* is equipped with a developing roller 5*am*, and the developing roller 5*am* is provided such that a part thereof projects toward the outside of the developing part 5*m* from the opening formed on the side facing the photoreceptor drum 2*m* and is close to the surface of the photoreceptor drum 2*m*. The developing roller 5*am* can use the same member as the developing roller 5*a*. According to the developing part 5*m*, a magenta developer borne on the surface of the developing roller 5*am* is fed to an electrostatic latent image on the surface of the photoreceptor drum 2*m*. This forms a toner image (magenta toner image) comprising a magenta toner on the surface of the photoreceptor drum 2*m*.

The developing part 5*c* is a container-like member provided so as to face the photoreceptor drum 2*c*. The developing part 5*c* stores a cyan developer in its inner space. The cyan developer is a one-component developer consisting of a cyan toner which is a chromatic toner for forming an image of cyan, or a two-component developer comprising the cyan toner and the known carrier. The cyan toner comprises, for example, a polyester resin as a resin binder, C.I. Pigment Blue 15:3 as a colorant, and a metal alkyl salicylate as a charge control agent.

The developing part 5*c* has an opening formed on the side facing the photoreceptor drum 2*c*. The developing part 5*c* is equipped with a developing roller 5*ac*, and the developing roller 5*ac* is provided such that a part thereof projects toward the outside of the developing part 5*c* from the opening formed on the side facing the photoreceptor drum 2*c* and is close to the surface of the photoreceptor drum 2*c*. The developing roller 5*ac* can use the same member as the developing roller 5*a*. According to the developing part 5*c*, a cyan developer borne on the surface of the developing roller 5*ac* is fed to an electrostatic latent image on the surface of the photoreceptor drum 2*c*. This forms a toner image (cyan toner image) comprising a cyan toner on the surface of the photoreceptor drum 2*c*.

The developing part 5*k* is a container-like member provided so as to face the photoreceptor drum 2*k*. The developing part 5*k* stores a black developer in its inner space. The black developer is a one-component developer consisting of a black toner which is a chromatic toner for forming an image of black, or a two-component developer comprising the black toner and the known carrier. The black toner comprises, for example, a polyester resin as a resin binder, carbon black as a colorant, and a metal alkyl salicylate as a charge control agent.

The developing part 5*k* has an opening formed on the side facing the photoreceptor drum 2*k*. The developing part 5*k* is equipped with a developing roller 5*ak*, and the developing roller 5*ak* is provided such that a part thereof projects toward the outside of the developing part 5*k* from the opening formed on the side facing the photoreceptor drum 2*k* and is close to the surface of the photoreceptor drum 2*k*. The developing roller 5*ak* can use the same member as the developing roller 5*a*. According to the developing part 5*k*, a black developer borne on the surface of the developing roller 5*ak* is fed to an electrostatic latent image on the surface of the photoreceptor drum 2*k*. This forms a toner image (black toner image) comprising a black toner on the surface of the photoreceptor drum 2*k*.

The transfer part 7*y* is a roller-like member provided so as to face the photoreceptor drum 2*y*. The transfer part 7*y* sandwiches the recording medium P sent from the conveying rollers 13*b* described hereinafter between the transfer part 7*y* and the photoreceptor drum 2*y*, thereby transferring a yellow toner image on the surface of the photoreceptor drum 2*y* to the recording medium P in a region (fifth transfer region) sandwiched between the photoreceptor drum 2*y* and the transfer part 7*y*. The recording medium P having a yellow toner image transferred thereto is sent to the conveying belt 23 described hereinafter by the transfer part 7*y*. The transfer part 7*y* can use the same member as the transfer part 7.

The transfer part 7*m* is a roller-like member provided so as to face the photoreceptor drum 2*m*. The transfer part 7*m* sandwiches the recording medium P sent from the conveying belt 23 described hereinafter between the transfer part 7*m* and the photoreceptor drum 2*m*, thereby transferring a magenta toner image on the surface of the photoreceptor drum 2*m* to the recording medium P in a region (fourth transfer region) sandwiched between the photoreceptor drum 2*m* and the transfer part 7*m*. The recording medium P having a magenta toner image transferred thereto is sent to the conveying belt 25 described hereinafter by the transfer part 7*m*. The transfer part 7*m* can use the same member as the transfer part 7.

The transfer part 7*c* is a roller-like member provided so as to face the photoreceptor drum 2*c*. The transfer part 7*c* sandwiches the recording medium P sent from the conveying belt 25 described hereinafter between the transfer part 7*c* and the photoreceptor drum 2*c*, thereby transferring a cyan toner image on the surface of the photoreceptor drum 2*c* to the recording medium P in a region (third transfer region) sandwiched between the photoreceptor drum 2*c* and the transfer part 7*c*. The recording medium P having a cyan toner image transferred thereto is sent to the conveying belt 27 described hereinafter by the transfer part 7*c*. The transfer part 7*c* can use the same member as the transfer part 7.

The transfer part 7*k* is a roller-like member provided so as to face the photoreceptor drum 2*k*. The transfer part 7*k* sandwiches the recording medium P sent from the conveying belt 27 described hereinafter between the transfer part 7*k* and the photoreceptor drum 2*k*, thereby transferring a black toner image on the surface of the photoreceptor drum 2*k* to the recording medium P in a region (second transfer region) sandwiched between the photoreceptor drum 2*k* and the transfer part 7*k*. The recording medium P having a black toner image transferred thereto is sent to the conveying belt 29 described hereinafter by the transfer part 7*k*. The transfer part 7*k* can use the same member as the transfer part 7.

The drum cleaner 10*y* is a member which removes and collects a residual yellow toner on the surface of the photoreceptor drum 2*y* after the yellow toner image on the surface of the photoreceptor drum 2*y* has been transferred to the recording medium P. The drum cleaner 10*m* is a member which removes and collects a residual magenta toner on the surface of the photoreceptor drum 2*m* after the magenta toner image on the surface of the photoreceptor drum 2*m* has been transferred to the recording medium P. The drum cleaner 10*c* is a member which removes and collects a residual cyan toner on the surface of the photoreceptor drum 2*c* after the cyan toner image on the surface of the photoreceptor drum 2*c* has been transferred to the recording medium P. The drum cleaner 10*k* is a member which removes and collects a residual black toner on the surface of the photoreceptor drum 2*k* after the black toner image on the surface of the photoreceptor drum 2*k* has been transferred to the recording medium P. The drum cleaners 10*y*, 10*m*, 10*c* and 10*k* can use the same member as the drum cleaner 10.

The conveying belt 23 is an endless belt-like member supported around the supporting rollers 22*a* and 22*b* with tension. The conveying belt 23 sends the recording medium P sent from the fifth transfer region to the fourth transfer region by moving the recording medium P due to the rotation thereof while bearing the same thereon. The conveying belt 25 is an endless belt-like member supported around the supporting rollers 24*a* and 24*b* with tension. The conveying belt 25 sends the recording medium P sent from the fourth transfer region to the third transfer region by moving the recording medium P due to the rotation thereof while bearing the same thereon.

The conveying belt 27 is an endless belt-like member supported around the supporting rollers 26*a* and 26*b* with tension. The conveying belt 27 sends the recording medium P sent from the third transfer region to the second transfer region by moving the recording medium P due to the rotation thereof while bearing the same thereon. The conveying belt 29 is an endless belt-like member supported around the supporting rollers 28*a* and 28*b* with tension. The conveying belt 29 sends the recording medium P sent from the second transfer region to the first transfer region by moving the recording medium P due to the rotation thereof while bearing the same thereon.

Thus, the recording medium P passes through the fifth transfer region, the fourth transfer region, the third transfer region, the second transfer region and the first transfer region, in this order. The conveying belt 23 can use, for example, a semiconductor polycarbonate belt having a thickness of 200 μm.

The supporting rollers 22*a*, 22*b*, 24*a*, 24*b*, 26*a*, 26*b*, 28*a* and 28*b* are a roller-like member provided so as to be rotatable around an axis thereof by a driving part (not shown). The supporting rollers, 22*a*, 22*b*, 24*a*, 24*b*, 26*a*, 26*b*, 28*a* and 28*b* use, for example, an aluminum cylindrical body (pipe-like roller).

In the image forming apparatus 1*c* constituted as above, the control unit part 700 controls each member such that a transparent toner image is transferred to a recording medium P having'a chromatic toner image transferred thereto, and the transparent toner image is fixed to an image formed on the recording medium, thereby forming a transparent toner coat layer. That is, the control unit part 700 controls each member such that formation of an image by a chromatic toner image and formation of a transparent toner coat layer are conducted by one time fixing.

In more detail, by passing a recording medium P through the fifth to second transfer regions, a yellow toner image, a magenta toner image, a cyan toner image and a black toner image are overlaid on the recording medium P in this order. This forms an unfixed full color image on the recording medium P. Thereafter, by passing the recording medium P through the first transfer region, a transparent toner image is transferred to the unfixed full color image. By passing the recording medium P having borne thereon the unfixed full color image and the transparent toner image through the fixing part 600, formation of an image by a toner image comprising a chromatic toner and formation of a transparent toner coat layer are conducted at once.

Thus, according to the image forming apparatus 1*c* of the second aspect of the invention, an image coated with a transparent toner coat layer can be formed on a recording medium P. As a result, an image having excellent rubbing resistance, waterproof property and storage stability can be formed.

The control unit part 700 may control each member such that after formation of a full color image to a recording medium P, a toner image for a coat layer is transferred to the recording medium P, and a transparent toner coat layer is then formed thereon. Such a control of the control unit part 700 can suppress a transparent toner constituting a transparent toner coat layer from permeating an image.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a photoreceptor having a photosensitive layer;

a charging device which charges the photoreceptor;

an exposure device which exposes the charged photoreceptor to light, thereby forming an electrostatic latent image on a surface of the photoreceptor;

a first developing device which feeds a photoreactive toner which produces a given color by being irradiated with given light and further being heated, to the electrostatic latent image, thereby forming a toner image on a surface of the photoreceptor;

a color formation exposure device which exposes the photoreactive toner forming the toner image with given light;

a transfer device which transfers the toner image to a recording medium;

a fixing device which fixes the toner image transferred to the recording medium, onto the recording medium by heating the recording medium, thereby forming an image on the recording medium; and a control device which controls operations of the photoreceptor, the charging device, the exposure device, the first developing device, the color formation exposure device, the transfer device and the fixing device, the control device carrying out control such that a photoreactive toner processed so as not to develop a color is transferred to a recording medium having transferred or fixed thereto a toner image processed so as to develop a color, and the photoreactive toner processed so as not to develop a color is fixed to an image formed on the recording medium, thereby forming a transparent toner coat layer which is a colorless and transparent toner layer.

2. The image forming apparatus of claim 1, wherein the control device carries out control such that a first fixing temperature which is a temperature of the fixing device when fixing the toner image to a recording medium is higher than a second fixing temperature which is a temperature of the fixing device when forming the transparent toner coat layer.

3. The image forming apparatus of claim 1, wherein the transfer device includes a recording medium reversing part which reverses a recording medium by a switchback mechanism such that a side of the recording medium opposite a side facing the photoreceptor in just before transferring faces the photoreceptor in the next transfer.

4. The image forming apparatus of claim 1, further comprising a second developing device which feeds a black toner being a toner for forming a black image to the electrostatic latent image, thereby forming the toner image, wherein the control device further controls operations of the second developing device, and the control device carries out control so as to form the black image by the black toner in a case where an image to be formed on the recording medium contains a black image.

5. The image forming apparatus of claim 4, wherein the photoreceptor includes a first photoreceptor on which the toner image is formed by the first developing device, and a second photoreceptor on which the toner image is formed by the second developing device, the transfer device is constituted such that the toner image comprising the photoreactive toner is transferred to the recording medium, and the toner image comprising the black toner is then transferred to the recording medium, and the control device carries out control such that the toner image transferred to the recording medium is fixed to the recording medium, the photoreactive toner processed so as not to develop a color is transferred to the recording medium, and the transparent toner coat layer is then formed on the recording medium.

6. The image forming apparatus of claim 5, further comprising a second photoreceptor separating/contacting part which separates/contacts the second photoreceptor and the transfer device by moving the second photoreceptor, wherein the control device further controls operations of the second photoreceptor separating/contacting part, and the control device carries out control such that the second photoreceptor separates from the transfer device, except when the toner image comprising a black toner is transferred to the recording medium.

7. The image forming apparatus of claim 4, wherein the photoreceptor includes a first photoreceptor on which the toner image is formed by the first developing device, and a second photoreceptor on which the toner image is formed by the second developing device, the transfer device is constituted such that a toner image comprising the black toner is transferred to the recording medium, and a toner image comprising the photoreactive toner is then transferred to the recording medium, and the control device carries out control such that in a case where an image to be formed on the recording medium consists of a black image, the toner image consisting of a black toner is transferred to the recording medium, a photoreactive toner processed so as not to develop a color is transferred to the recording medium before fixing the toner image to the recording medium, and fixation of the toner image to the recording medium and formation of the transparent toner coat layer are then conducted at once.

8. The image forming apparatus of claim 7, further comprising a second photoreceptor separating/contacting part which separates/contacts the second photoreceptor and the transfer device by moving the second photoreceptor, wherein the control device further controls operations of the second photoreceptor separating/contacting part, and the control device carries out control such that the second photoreceptor separates from the transfer device, except when the toner image comprising a black toner is transferred to the recording medium.

* * * * *